US006867544B2

(12) United States Patent
Takahashi et al.

(10) Patent No.: US 6,867,544 B2
(45) Date of Patent: Mar. 15, 2005

(54) HIGH PRESSURE DISCHARGE LAMP AND METHOD FOR PRODUCING THE SAME

(75) Inventors: Kiyoshi Takahashi, Kyoto (JP); Yuriko Kaneko, Nara (JP); Makoto Horiuchi, Nara (JP); Tomoyuki Seki, Osaka (JP); Tsuyoshi Ichibakase, Osaka (JP); Shinichiro Hataoka, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 72 days.

(21) Appl. No.: 10/234,947

(22) Filed: Sep. 4, 2002

(65) Prior Publication Data

US 2003/0052603 A1 Mar. 20, 2003

(30) Foreign Application Priority Data

Sep. 4, 2001 (JP) ..... 2001-267487

(51) Int. Cl.[7] ..... H01J 61/04; H01J 61/10

(52) U.S. Cl. ..... 313/574; 313/483; 313/484; 313/491; 313/567

(58) Field of Search ..... 313/483, 484, 313/490, 491, 567, 570, 572, 574, 623, 624, 625, 575

(56) References Cited

U.S. PATENT DOCUMENTS 3,581,133 A * 5/1971 Ushio ..... 313/632
4,550,269 A 10/1985 Dixon
5,109,181 A 4/1992 Fischer et al.
5,468,168 A 11/1995 Balaschak et al.
5,598,063 A 1/1997 Mathews et al.
5,834,895 A * 11/1998 Dolan et al. ..... 313/570
6,137,228 A 10/2000 Aizawa et al.

U.S. PATENT DOCUMENTS 6,271,628 B1 8/2001 Sugitani et al.
6,486,603 B1 * 11/2002 Ikeuchi et al. ..... 313/491
2002/0000777 A1 1/2002 Horiuchi et al.
2002/0047611 A1 4/2002 Kaneko et al.

FOREIGN PATENT DOCUMENTS

EP 0 903 771 A2 3/1999
JP 49-004384 1/1974

(List continued on next page.)

OTHER PUBLICATIONS

U.S. Appl. No. 10/111,067, filed Apr. 18, 2002, Horiuchi et al.

*Primary Examiner*—Nimeshkumar D. Patel
*Assistant Examiner*—Sharlene Leurig
(74) *Attorney, Agent, or Firm*—Harness, Dickey & Pierce, P.L.C.

(57) ABSTRACT

A high pressure discharge lamp includes a luminous bulb in which a pair of electrodes are opposed to each other in the bulb. At least mercury and halogen are contained in the luminous bulb, and at least one metal selected from the group consisting of Pt, Ir, Rh, Ru and Re is present in the luminous bulb.

20 Claims, 14 Drawing Sheets

FOREIGN PATENT DOCUMENTS

| | | | |
|---|---|---|---|
| JP | 49-023978 | | 3/1974 |
| JP | 49-072970 | | 7/1974 |
| JP | 49-072972 | | 7/1974 |
| JP | 52005988 | A | 1/1977 |
| JP | 54-39973 | | 3/1979 |
| JP | 2-148561 | | 6/1990 |
| JP | 04298951 | A | 10/1992 |
| JP | 06089703 | A | 3/1994 |
| JP | 06208831 | A | 7/1994 |
| JP | 07050153 | A | 2/1995 |
| JP | 07-282719 | | 10/1995 |
| JP | 07296781 | A | 11/1995 |
| JP | 09165641 | A | 6/1997 |
| JP | 09231939 | A | 9/1997 |
| JP | 10255720 | A | 9/1998 |
| JP | 10-269941 | | 10/1998 |
| JP | 11-260315 | A | 9/1999 |
| JP | 11-297268 | | 10/1999 |
| JP | 200067811 | A | 3/2000 |
| JP | 2000195468 | A | 7/2000 |
| JP | 2000-509893 | | 8/2000 |
| JP | 2000260391 | A | 9/2000 |
| JP | 2000299085 | A | 10/2000 |
| JP | 2000315456 | A | 11/2000 |
| JP | 2000323091 | A | 11/2000 |
| JP | 2001023570 | A | 1/2001 |
| JP | 2001102005 | A | 4/2001 |
| JP | 2001-118542 | A | 4/2001 |
| JP | 2001167738 | A | 6/2001 |
| JP | 2001216937 | A | 8/2001 |
| JP | 2001307679 | A | 11/2001 |
| JP | 2002008596 | A | 1/2002 |
| JP | 2002-519833 | | 7/2002 |
| JP | 2002270133 | A | 9/2002 |
| JP | 2002352772 | A | 12/2002 |
| WO | WO 98/37571 | | 8/1998 |
| WO | WO 00/00996 | | 1/2000 |
| WO | WO 01/29862 | A1 | 4/2001 |

* cited by examiner

HIGH PRESSURE DISCHARGE LAMP AND METHOD FOR PRODUCING THE SAME

BACKGROUND OF THE INVENTION

The present invention relates to a high pressure discharge lamp and a method for producing the same. In particular, the present invention relates to a high pressure discharge lamp used for general illumination or other applications such as projectors and headlights of automobiles when it is used in combination with a reflecting mirror.

In recent years, an image projection apparatus such as a liquid crystal projector and a DMD projector has been widely used as a system for realizing large-scale screen images, and a high pressure discharge lamp having a high intensity has been commonly and widely used in such an image projection apparatus. FIG. 14 is a schematic view showing the structure of a conventional high pressure discharge lamp 1000. The lamp 1000 is a so-called ultra-high pressure mercury lamp.

The lamp 1000 includes a luminous bulb 110 made of quartz glass, and a pair of sealing portions 120 (seal portions) extending from both ends of the luminous bulb 110. In the luminous bulb 110 (discharge space), a luminous material (mercury) 118 is enclosed, and a pair of tungsten electrodes (W electrode) 112 made of tungsten are opposed to each other with a certain gap. One end of the W electrode 112 is welded to a molybdenum foil (Mo foil) 124 in the sealing portion 120, and the W electrode 112 and the Mo foil 124 are electrically connected. An external lead (Mo rod) 126 made of molybdenum is electrically connected to one end of the Mo foil 124. In addition to the mercury 118, argon (Ar) and a small amount of halogen are enclosed in the luminous bulb 110.

Next, the operational principle of the lamp 1000 will be described. When a start voltage is applied to the W electrodes 112 and 112' via the external leads 126 and the Mo foils 124, discharge of argon (Ar) occurs. Then, this discharge raises the temperature in the discharge space of the luminous bulb 110, and thus the mercury 118 is heated and evaporated. Thereafter, mercury atoms are excited and become luminous in the arc center between the W electrodes 112 and 112. As the pressure of the mercury vapor pressure of the lamp 1000 is higher, the lamp is more suitable as a light source for an image projection apparatus. However, in view of the physical strength against pressure of the luminous bulb 110, the lamp 1000 is used at a mercury vapor pressure of 15 to 25 MPa (150 to 200 atm).

The conventional lamp 1000 has a strength against a pressure about 20 MPa, but research and development to increase the strength against pressure have been conducted in order to improve the lamp characteristics further. However, a high pressure discharge lamp having a significantly high strength against pressure (e.g., about 30 MPa or more) for practical use has not been realized yet. Also there is a demand for a long life of a lamp and it is preferable that in the high pressure discharge lamp, blackening occurring in the luminous bulb 110 can be prevented effectively.

SUMMARY OF THE INVENTION

Therefore, with the foregoing in mind, it is a main object of the present invention to provide a high pressure discharge lamp having better characteristics (e.g., high strength against pressure, long life) than those of a conventional high pressure discharge lamp.

A first high pressure discharge lamp of the present invention includes a luminous bulb in which a pair of electrodes are opposed to each other in the bulb. At least mercury and halogen are contained in the luminous bulb, and at least one metal selected from the group consisting of Pt, Ir, Rh, Ru and Re is present in the luminous bulb.

In one preferable embodiment, the amount of mercury enclosed per unit volume of the luminous bulb is 230 mg/cc or more.

It is preferable that the amount of mercury enclosed per unit volume of the luminous bulb is 300 mg/cc or more.

In one preferable embodiment, the operating pressure in the luminous bulb is 23 MPa or more.

It is preferable that the operating pressure in the luminous bulb is 30 MPa or more.

It is preferable that the metal present in the luminous bulb is Pt.

A second high pressure discharge lamp of the present invention includes a luminous bulb in which a pair of electrodes are opposed to each other in the bulb, and a sealing portion extending from the luminous bulb and having a portion of the electrode therein. A metal film made of at least one metal selected from the group consisting of Pt, Ir, Rh, Ru and Re is formed on a surface of at least a part of the portion of the electrode that is positioned in the sealing portion.

In one preferable embodiment, the electrode is connected to a metal foil provided in the sealing portion by welding, and the metal film is not formed on a welded portion with the metal foil, and formed on a surface of the electrode that is buried in the sealing portion.

It is preferable that a part of the metal constituting the metal film is present in the luminous bulb.

In one preferable embodiment, the metal film is made of Pt.

In one preferable embodiment, the metal film may have a multilayered structure including an Au layer as a lower layer and a Pt layer as an upper layer.

A third high pressure discharge lamp of the present invention includes a luminous bulb in which a pair of electrodes are opposed to each other in the bulb; a metal foil connected to the electrode by welding; and a sealing portion extending from the luminous bulb and sealing the metal foil. The metal foil and a portion of the electrode are buried in the sealing portion. A metal film made of at least one metal selected from the group consisting of Pt, Ir, Rh, Ru and Re is formed on a surface of the portion of the electrode that is buried in the sealing portion, and $A<B$ is satisfied, where A is the thickness of the metal film in a welded portion of the metal foil and the electrode, and B is the thickness of the metal film in portions other than the welded portion.

A fourth high pressure discharge lamp of the present invention includes a luminous bulb in which a pair of electrodes are opposed to each other in the bulb; a metal foil connected to the electrode by welding; and a sealing portion extending from the luminous bulb and sealing the metal foil. The metal foil and a portion of the electrode are buried in the sealing portion. A metal film made of at least one metal selected from the group consisting of Pt, Ir, Rh, Ru and Re is formed on a surface of the portion of the electrode that is buried in the sealing portion, and $C<2D$ is satisfied, where C is the width of the metal foil in a welded portion of the metal foil and the electrode, and D is the outer diameter of the electrode in the welded portion.

It is preferable that a part of the metal constituting the metal film is present in the luminous bulb.

In one preferable embodiment, the metal film is made of Pt.

In one preferable embodiment, the metal film may have a multilayered structure including an Au layer as a lower layer and a Pt layer as an upper layer.

A fifth high pressure discharge lamp of the present invention includes a luminous bulb in which a pair of electrodes are opposed to each other in the bulb; and a sealing portion extending from the luminous bulb and having a portion of the electrode inside. A coil having at least one metal selected from the group consisting of Pt, Ir, Rh, Ru and Re on its surface is wound around the portion of the electrode that is positioned in the sealing portion.

A sixth high pressure discharge lamp of the present invention includes a luminous bulb in which a pair of electrodes are opposed to each other in the bulb; a metal foil connected to the electrode by welding; and a sealing portion extending from the luminous bulb and sealing the metal foil. The metal foil and a portion of the electrode are buried in the sealing portion. A coil having at least one metal selected from the group consisting of Pt, Ir, Rh, Ru and Re on its surface is wound around the electrode that is buried in the sealing portion.

It is preferable that a part of the metal constituting the metal film is present in the luminous bulb.

It is preferable that the coil has a metal film made of Pt on its surface.

In one preferable embodiment, the coil has a metal film having a multilayered structure including an Au layer as a lower layer and a Pt layer as an upper layer on its surface.

It is preferable that at least mercury and halogen are contained in the luminous bulb, and at least one metal selected from the group consisting of Pt, Ir, Rh, Ru and Re is present in the luminous bulb.

In one preferable embodiment, the amount of mercury enclosed per unit volume of the luminous bulb is 230 mg/cc or more.

It is preferable that the amount of mercury enclosed per unit volume of the luminous bulb is 300 mg/cc or more.

In one preferable embodiment, the operating pressure in the luminous bulb is 23 MPa or more.

It is preferable that the operating pressure in the luminous bulb is 30 MPa or more.

It is preferable that the metal present in the luminous bulb is Pt.

A method for producing a high pressure discharge lamp of the present invention includes the steps of (a) preparing a glass tube including a luminous bulb portion that is to serve as a luminous bulb of a high pressure discharge lamp and a side tube portion extending from the luminous bulb portion, (b) preparing an electrode structure in which one end of an electrode rod is connected to a metal foil by welding, and a metal film made of at least one metal selected from group consisting of Pt, Ir, Rh, Ru, and Re is formed on a surface of a part of the portion of the electrode rod that is positioned in the side tube portion, (c) inserting the electrode structure into the side tube portion such that a head of the electrode rod is positioned inside the luminous bulb portion, and (d) heating and sealing the side tube portion so that the side tube portion and the metal foil are attached tightly.

In one preferable embodiment, in the step (b), the electrode structure that satisfies $A<B$ is prepared, where A is the thickness of the metal film in a welded portion of the metal foil and the electrode rod, and B is the thickness of the metal film in portions other than the welded portion.

In one preferable embodiment, in the step (b), the electrode structure that satisfies $C<2D$ is prepared, where C is the width of the metal foil in a welded portion of the metal foil and the electrode rod, and D is the outer diameter of the electrode rod in the welded portion.

It is preferable that the metal film in the step (b) is made of Pt.

It is preferable that the metal film in the step (b) has a multilayered structure including an Au layer as a lower layer and a Pt layer as an upper layer.

It is preferable that a part of the metal constituting the metal film is introduced into the luminous bulb portion by heating in the step (d).

A method for producing a high pressure discharge lamp of the present invention includes the steps of (a) preparing a glass tube including a luminous bulb portion that is to serve as a luminous bulb of a high pressure discharge lamp and a side tube portion extending from the luminous bulb portion, (b) preparing an electrode structure in which one end of an electrode rod is connected to a metal foil by welding, and a coil having at least one metal selected from group consisting of Pt, Ir, Rh, Ru, and Re on its surface is wound around the portion of the electrode rod that is positioned in the side tube portion, (c) inserting the electrode structure into the side tube portion such that a head of the electrode rod is positioned inside the luminous bulb portion, and (d) heating and sealing the side tube portion so that the side tube portion and the metal foil are attached tightly.

In one preferable embodiment, in the step (b) of preparing an electrode structure includes inserting the electrode rod in the electrode structure through the coil having the at least one metal on its surface; and welding the coil through which the electrode rod is inserted to the electrode rod.

In one preferable embodiment, the coil in the step (b) has a film made of Pt on its surface.

In one preferable embodiment, the coil in the step (b) has a metal film having a multilayered structure including an Au layer as a lower layer and a Pt layer as an upper layer.

It is preferable that a part of the metal coating the surface of the coil is introduced into the luminous bulb portion by heating in the step (d).

In one preferable embodiment, the method for producing a high pressure discharge lamp further includes introducing at least mercury and halogen into the luminous bulb portion.

In one preferable embodiment, the amount of mercury enclosed per unit volume of the luminous bulb is 230 mg/cc or more in the introducing step. It is preferable that the amount of mercury enclosed per unit volume of the luminous bulb is 300 mg/cc or more in the introducing step.

The present invention can provide a high pressure discharge lamp exhibiting better characteristics (e.g., high strength against pressure, long life) than those of a conventional high pressure discharge lamp. When at least one metal selected from the group consisting of Pt, Ir, Rh, Ru, and Re is present in the luminous bulb, a high pressure discharge lamp having a long life in which blackening can be effectively prevented from occurring can be provided. When a metal film made of at least one metal selected from the group consisting of Pt, Ir, Rh, Ru, and Re is formed on the surface of at least a part of the portion of the electrode that is positioned in the sealing portion, a high pressure discharge lamp having a high strength against pressure in which cracks that might be otherwise generated in the sealing portion positioned around the electrode can be suppressed from being generated can be provided. Furthermore, when the metal film is not formed in the welded portion, the effect of preventing foil floating can be obtained. Also when a coil having at least one metal selected from the group consisting of Pt, Ir, Rh, Ru, and Re on its surface is wound around the portion of the electrode that is positioned in the sealing portion, cracks can be suppressed from being generated.

BRIEF DESCRIPTION OF THE DRAWINGS

FIGS. 9A to 9D are cross-sectional views for illustrating a process sequence of another method for producing a coil 40.

DETAILED DESCRIPTION OF THE INVENTION

Figure 1A:
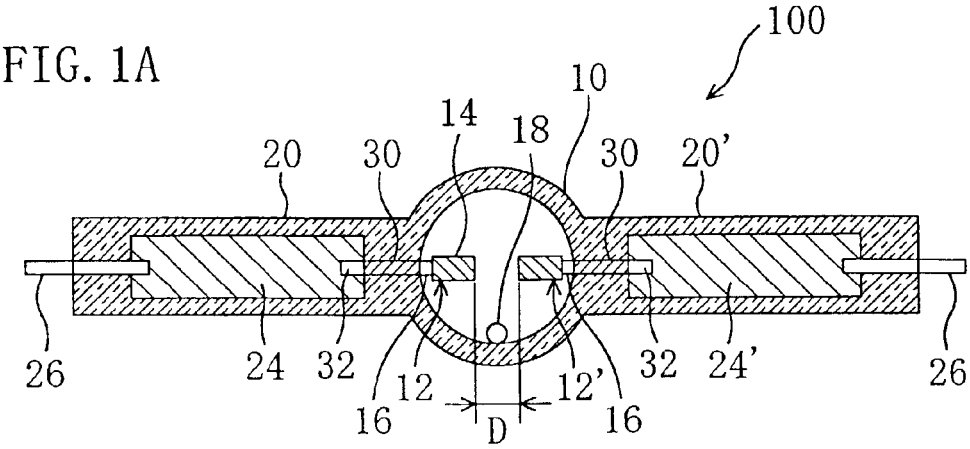
FIG. 1A is a schematic plan cross-sectional view showing the structure of a high pressure discharge lamp 100 of Embodiment 1 of the present invention.

The inventors of the present invention conducted examinations from many aspects in order to improve the characteristics of a high pressure mercury lamp (especially ultra-high pressure mercury lamp), which is one type of high pressure discharge lamps, and found out by experiments that when Pt element is put in a luminous bulb, blackening occurring in the luminous bulb can be prevented effectively. This knowledge will be described in greater detail below.

It has been believed that when a lamp of this type is operated, the minimum temperature of the inner wall of the luminous bulb is generally about 900° C. and no material can act as an oxygen getter at such a high temperature. However, when the inventor of the present invention conducted life tests of an ultra-high pressure mercury lamp enclosing Pt in the luminous bulb, the Pt acts as an oxygen getter, and blackening is suppressed. It was also found out that not only Pt, but also elements of the platinum group such as Ir, Rh, Ru, and Re can act as an oxygen getter at a high temperature during lamp operation. It was confirmed that Au does not act as an oxygen getter, but does not facilitate blackening either. The inventors of the present invention also investigated the characteristics of a lamp in which the surfaces of the portions of electrodes buried in sealing portions are coated with Pt, which turned out to act as an oxygen getter. Then, it was further found out that the strength against pressure of the lamp can be improved significantly. The present invention was achieved based on these new findings.

Hereinafter, embodiments of the present invention will be described with reference to the accompanying drawings. For simplification, in the following drawings, the elements having substantially the same function bear the same reference numerals. The present invention should not be construed to be limited by the following embodiments.

Embodiment 1

Figure 1B:
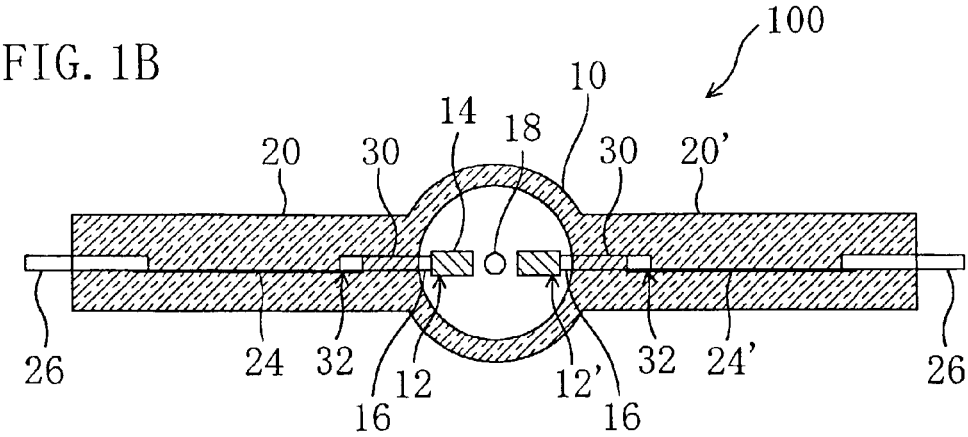
FIG. 1B is a schematic side cross-sectional view of FIG. 1A.

FIGS. 1A and 1B are schematic views showing the cross-sectional structure of a high pressure discharge lamp of this embodiment. FIG. 1A is a plan view, and FIG. 1B is a side view.

A lamp 100 includes a luminous bulb 10 in which a pair of electrodes (12, 12') are opposed inside the bulb, and a pair of sealing portions 20 and 20' connected to the luminous bulb 10. The luminous bulb 10 is made of quartz glass, and the glass portions of the sealing portions (20, 20') are extending from the luminous bulb 10. A portion (base portion) of the electrodes (12, 12') is buried in the sealing portions (20, 20'), and a metal film 30 made of at least one metal selected from the group consisting of Pt, Ir, Rh, Ru, and Re is formed on a surface of at least a part of the portion of the electrodes (12, 12') that is buried in the sealing portions (20, 20'). In this embodiment, the metal film 30 containing Pt is formed by plating in a portion of the electrodes (12, 12), and a part of the Pt in the metal film 30 is present in the luminous bulb 10.

The electrodes (12, 12') are provided in the luminous bulb 10 with a gap (arc length) D of about 0.2 to 5 mm (e.g., 0.6 to 1.0 mm), each of the electrodes (12, 12') is constituted by an electrode rod 16 made of tungsten. One end of the electrode rod 16 is connected to metal foils (24, 24') provided in the sealing portions (20, 20') by welding. The metal film 30 containing Pt is not formed in a welded portion (connection portion) 32 of the electrode rod 16 and the metal foil 24, and is formed on a surface of the electrode rod 16 buried in the sealing portions (20, 20'). A coil 14 is wound around the other end (head) of the electrode rod 16 for the purpose of reducing the temperature of the electrode head during lamp operation.

In this embodiment, in order to improve the attachment with the tungsten constituting the electrode rod 16, the metal film 30 has a multilayered structure including an Au layer as a lower layer and a Pt layer as an upper layer. The Au layer and the Pt layer are formed by plating. The thickness of the Au layer is, for example, 0.01 to 0.1 $\mu$m, and the length (plating length) in the longitudinal length of the Au layer is about 2 mm. The thickness of the Pt layer formed on the Au layer is about 0.01 to about 10 $\mu$m (preferably, about 0.1 $\mu$m), and the length (plating length) in the longitudinal length of the Pt layer is about 2 mm, as the plating length of the Au layer. The amount of plating is, for example about 1 to 4 mg for Au and about 4 mg for Pt with respect to one electrode rod 16.

The metal film 30 is not necessarily a multilayered film of the Au layer and the Pt layer, but may be a film of Pt. In the case where the metal film 30 is constituted by only Pt, although the attachment is slightly lower than in the case of the multilayered film of the Au layer and the Pt layer, a sufficient attachment that cannot cause any problem in practical use can be obtained, which was confirmed by the experiments of the inventors of the present invention. The metal film 30 made only of Pt provides the advantage that it can be formed easily than the multilayered film of the Au layer and the Pt layer. The thickness of the metal film 30 made of Pt is, for example, about 0.01 $\mu$m to about 1.0 $\mu$m.

The metal foils (24, 24') provided in the sealing portions (20, 20') are, for example, rectangular molybdenum foils (Mo foils), and lead wires (external leads) 26 are provided on the opposite side to the side on which the electrodes (12, 12') are positioned by welding. This pair of lead wires 26 are electrically connected to a ballast (not shown). The sealing portions (20, 20') serve to maintain airtightness in the discharge space in the luminous bulb 10 by attaching the glass portions of the sealing portions and the metal foils (24, 24') with pressure. A sealing mechanism by the sealing portions (20, 20') will be described below.

From the viewpoint of thermal expansion coefficient, quartz glass, which constitutes the glass portion of the sealing portions (20, 20'), has a different thermal expansion coefficient from that of molybdenum, which constitutes the metal foils (24, 24'), so that they cannot be integrated. However, in the case of this constitution, the metal foils (24, 24') are plastically deformed by the pressure from the glass portions of the sealing portions so that a gap creased between them can be filled up. Therefore, the metal foils (24, 24') and the glass portions can be attached to each other so that the luminous bulb 10 can be sealed with the sealing portions (20, 20'). That is to say, sealing with the sealing portions (20, 20') is performed by foil sealing by attaching the metal foils (24, 24') and the glass portions with pressure.

Unlike the portion in which the sealing portions (20, 20') and the metal foils (24, 24') are positioned, in the portion in which the electrode rods 16 are buried, the glass portions of the sealing portions and the electrode rods are not attached tightly, and a gap that cannot be visually recognized is present. This gap is created by the difference in the thermal expansion coefficient between tungsten and quartz glass. In other words, the gap is created by the fact that in cooling, tungsten, which is a metal, is more likely to be contracted than quartz glass. It should be noted that tungsten is not plastically deformed unlike molybdenum, so that the gaps between the glass portions and the electrode rods 16 are not filled up.

In the lamp 100 of this embodiment, a small amount of Pt and Au is present in the luminous bulb 10. They have come to be present in the following manner. During heating in the process of producing a lamp, a part of Pt and Au constituting the metal film 30 formed on the surface of the base portion of the electrode rod 16 evaporates and is scattered to the luminous bulb 10 through the gap between the glass portion of the sealing portion and the electrode rod 16. Conventionally, it has been believed that when a metal such as Pt is present in the luminous bulb 10, it reacts with an enclosed material in the luminous bulb 10, which promotes blackening, resulting in a short life of the lamp. However, when the inventors of the present invention investigated the characteristics of the lamp 100, they confirmed that Pt effectively can prevent blackening of the luminous bulb 10 rather than promoting blackening. The mechanism by which Pt can prevent blackening is not clear at present, but it seems that during lamp operation, Pt acts as an oxygen getter, so that blackening can be suppressed. When this type of lamp is operated, in general, the minimum temperature in the inner wall of the luminous bulb 10 is about 900° C., and it has conventionally been believed that no material can act as a getter at such a high temperature.

On the other hand, it was confirmed that unlike Pt, Au does not act as an oxygen getter, but it does not facilitate blackening, either. Not only Pt, but Ir, Rh, Ru, and Re, which are elements of the platinum group, can act as an oxygen getter at a high temperature during lamp operation. In the lamp 100, Pt is scattered from the metal film 30 and introduced into the luminous bulb 10. This is an easy method for enclosing an appropriate amount of Pt to the luminous bulb 10. In other words, this method makes it possible to enclose Pt in the luminous bulb 10 in an amount that makes the Pt act as a getter and does not let the luminous bulb 10 be opaque. It is preferable not to let the luminous bulb 10 be opaque, because it can prevent a reduction of the amount of the light emitting from the luminous bulb 10.

The method for introducing an appropriate amount of Pt is not limited to the above method, and Pt can be introduced directly into the luminous bulb 10, or a metal film or a metal mass containing Pt can be provided in the luminous bulb 10. The method for forming the metal film 30 is not limited to plating, but sputtering or evaporation can be used, or a method of applying a metal solution and firing it can be also used.

The lamp 100 of this embodiment in which the metal film 30 is formed in the base portion of the electrode rode 16 exhibits the characteristics of having a high withstand pressure exceeding a conventional pressure of about 20 MPa (about 200 atm) (e.g., 23 MPa or 25 MPa or more, or 30 to 40 MPa or more, that is, an operating pressure of about 230 atm or 250 atm or more, or about 300 to 400 atm or more), in addition to the effect of preventing blackening with the action of Pt as a getter. In the lamp 100, the metal film 30 is formed on the surface of the portion of the electrode rod 16 that is buried in the sealing portions (20, 20'), so that small cracks are prevented from being generated in the glass position around the electrode rod 16. This will be described in greater detail below.

In the case of a lamp without the metal film 30 in the electrode rod 16 positioned in the sealing portion, when forming the sealing portion in the process of producing a lamp, the glass of the sealing portion and the electrode rod 16 are once attached, and then during cooling, they are detached because of the difference in the thermal expansion coefficient. At this time, cracks occur in the quartz glass around the electrode rod 16. This cracks conventionally have made it difficult to realize a lamp having such strength against pressure that the operating pressure exceeds about 200 atm. In other words, when a lamp is used at an operating pressure exceeding 200 atm, leakage of the luminous bulb 10 occurs, that is, the sealing structure of the sealing portions (20, 20') occurs. Therefore, in view of the strength against pressure, an ultra-high pressure mercury lamp that can withstand about 20 MPa or more has not been realized so far.

In the lamp 100 of this embodiment, the metal film 30 having a Pt layer on its surface is formed on the surface of the electrode rod 16, so that the wettability between the quartz glass of the sealing portions (20, 20') and the surface (Pt layer) of the electrode rod 16 becomes poor. In other words, the wettability between the metal and the quartz glass becomes poorer in the case of the combination of the platinum and the quartz glass than in the case of the tungsten and the quartz glass, so that they are detached more readily without being attached. Thus, the poor wettability between the electrode rod 16 and the quartz glass facilitates their detachment during cooling after heating, which can prevent small cracks from occurring. The lamp 100 produced based on the technical idea that the generation of cracks is prevented by utilizing poor wettability is an epoch-making lamp that can realize an operating pressure of 30 to 40 MPa, which are more than 20 MPa, and was either difficult or impossible to realize in the past.

The lamp 100 that can realize such high strength against pressure can provide the following advantages. In recent years, in order to obtain a high output and high power high pressure mercury lamp, a short arc type mercury lamp having a short arc length (distance D between the electrodes) (e.g., D is 2 mm or less) has been under development. In the case of the short arc type lamp, it is necessary to enclose a larger amount of mercury than usual in order to suppress the evaporation of the electrode from being speeded up due to an increase of current. As described above, in the conventional structure, there was the upper limitation on the strength against pressure, so that there was also the upper limitation of the amount of mercury to be enclosed (e.g., about 200 mg/cc or less). Therefore, there was a limitation on the realization of the lamp exhibiting better characteristics. The lamp 100 of this embodiment can eliminate such a conventionally present limitation, and can promote the development of the lamp exhibiting excellent characteristics that could not be realized in the past. The lamp 100 of this embodiment makes it possible to realize a lamp having an amount of mercury to be enclosed of more than about 200 mg/cc or about 300 mg/cc or more.

The technology that can realize an amount of mercury to be enclosed of about 300 to 400 mg/cc or more (operating pressure for lamp operation of 30 to 40 MPa) has a significance that the security and reliability of a lamp of a level exceeding the operating pressure for lamp operation of 20 MPa (that is, a lamp having an operating pressure exceeding current 15 to 20 MPa, for example a lamp with 23 MPa or more or 25 MPa or more) can be guaranteed. In the case of mass production of lamps, it is inevitable that there are variations in the characteristics of the lamps, so that it is necessary to ensure the withstand pressure with consideration for the margin, even for a lamp having a light operating pressure of about 23 MPa. Therefore, the technology that can achieve a withstand pressure of 30 MPa also provides a large advantage to lamps having a withstand pressure of less than 30 MPa from the viewpoint that products can be actually supplied. If lamps with 23 MPa or even lower are produced utilizing the technology that can achieve a withstand pressure of 30 MPa, the security and the reliability can be improved.

The inventors of the present invention conducted life tests with respect to the lamp 100 of this embodiment in which the base of the electrode rod 16 is plated with the metal film 30 and a lamp as a comparative example having the same structure as the lamp 100 except that the metal film 30 is not provided. The life tests were performed by repeating turning on for 60 minutes and then turning off for 15 minutes. When the lamp 100 was operated at 30 MPa or more, it was confirmed that leakage or breakage did not occur for 1500 hour operation. In the comparative lamp, it was confirmed that it was not able to be operated at 30 MPa, because it had cracks around the electrode rod 16.

Figure 2:
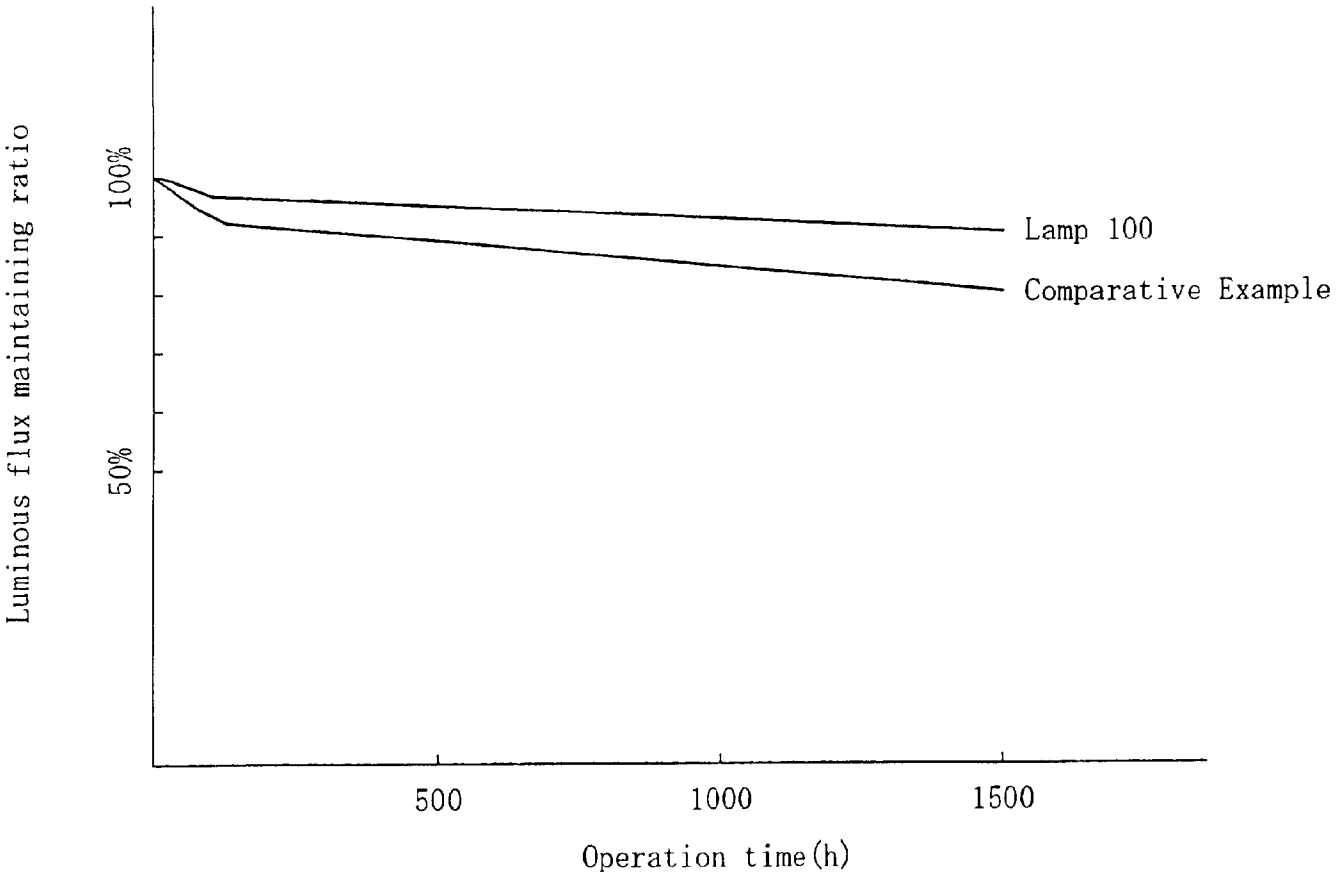
FIG. 2 is a graph showing the relationship between the operation time (h) and the luminous flux maintaining ratio.

FIG. 2 shows changes in the luminous flux maintaining ratio in the life test of the lamp 100 of this embodiment and the comparative lamp. Since the comparative lamp cannot be operated at 30 MPa, the amount of mercury that corresponds thereto (about 200 mg/cc) was used, and the distance D between the electrodes was adjusted so that the electrical characteristics of the lamp was equal to those of the lamp 100. As seen from FIG. 2, the luminous flux maintaining ratio of the lamp 100 was maintained at about 95% even at the time of 1500 hours. On the other hand, the luminous flux maintaining ratio of the comparative lamp was stared being reduced from a comparatively early time and became about 85%, which is lower than 90%, at the time of 1500 hours. These results indicate that the lamp 100 has excellent characteristics.

The illustrative conditions of the lamp 100 of this embodiment are as follows. The luminous bulb 10 is made of a high purity quartz glass containing a low level of alkali metal impurities (e.g., 1 ppm or less), and is substantially spherical. The outer diameter of the luminous bulb 10 is, for example, about 5 mm to 20 mm, and the thickness of the glass of the luminous bulb 10 is, for example, about 1 mm to 5 mm. The volume of discharge space in the luminous bulb 10 is, for example, 0.01 to 1 cc (0.01 to 1 $cm^3$). In this embodiment, the luminous bulb 10 having an outer diameter of about 9 mm, an inner diameter of about 4 mm, and a volume of discharge space of about 0.06 cc is used. Mercury is used as a luminous material 18, and about at least 300 mg/cc (e.g., 300 mg to 400 mg) and a rare gas (e.g., argon) with 5 to 30 MPa and a small amount of halogen are enclosed in the luminous bulb 10.

The enclosed halogen serves for the halogen cycles that returns W (tungsten) evaporated from the electrodes (12, 12') during lamp operation to the electrodes (12, 12') again. For example, bromine can be used. The enclosed halogen can be in the form of a halogen precursor, instead of the form of a single substance, and in this embodiment, halogen in the form of $CH_2Br_2$ is introduced into the luminous bulb 10. The amount of $CH_2Br_2$ is about 0.0017 to 0.17 mg/cc. This corresponds to about 0.01 to 1 $\mu$mol/cc in terms of the halogen atom density during lamp operation. The strength against pressure (operating pressure) of the lamp 100 can be 20 MPa or more (e.g., about 30 to 40 MPa or more). Moreover, a lamp having a bulb wall load, for example, in the range from about 60 W/$cm^2$ to 200 W/$cm^2$ (preferably about 80 to 150 W/$cm^2$) can be realized. The rated power is, for example, 150 W (the bulb wall load in this case corresponds to about 130 W/$cm^2$).

Furthermore, in the lamp 100 of this embodiment, the surface of the base portion of the electrode rod 16 is protected by the metal film 30, so that a larger amount of halogen than a regular amount can be enclosed. The reason for this is as follows. When a large amount of halogen is present in the luminous bulb 10, the problem is caused that excessive halogen other than those participating in the halogen cycle attacks the base of the electrode rod 16 and narrowed the base. In order to proceed satisfactorily with the halogen cycle to prevent blackening effectively, it is preferable that a slightly excessive amount of halogen is enclosed in many cases, but as described above, an excessive amount of halogen narrows the base of the electrode rod 16, which results in a short life. However, in the lamp 100 of this embodiment, the base portion is protected by the metal film 30, so that it is possible to avoid this problem of narrowing of the base of the electrode rod 16. Therefore, a larger amount of halogen than a regular amount can be enclosed in the luminous bulb 10. Thus, in the lamp 100 of this embodiment, the metal film 30 can act as a halogen attack preventing film, and it is possible to enclose halogen about 100 times as much as the conventional amount of halogen (e.g., about 0.17 to 17 mg/cc). Enclosing halogen in an amount more than necessary is not required by the lamp 100, and a specific amount of halogen can be determined as appropriate so that the desired characteristics can be obtained.

The conditions of the lamp 100 used in the lamp tests are as follows. The outer diameter and the inner diameter of the luminous bulb 10 are 9 mm and 4 mm, respectively. The volume of the luminous bulb 10 is about 0.06 cc. The electrode rod 16 is a tungsten electrode rod having a rod diameter of 0.3 mm. The metal foils (24, 24') are molybdenum foils having a width of 1.5 mm, and the lead wire 26 is made of molybdenum. The metal film 30 is a plated layer having a two-layered structure of Pt/Au (thickness of Au; 0.01 to 0.1 μm, thickness of Pt; about 0.1 μm), and the plating length is about 2 mm. The plating amount is about 1 to 4 μg for Au and about 4 μg for Pt per electrode. The mercury amount is 18 to 24 mg (the mercury amount per inner volume of the luminous bulb 10 is 300 to 400 mg/cc). The enclosing pressure of rare gas (Ar) containing halogen is 200 torr. The amount of $CH_2Br_2$ enclosed is about 0.017 mg/cc. The atom density of halogen during operation is about 0.1 μmol/cc.

In the lamp 100 shown in FIG. 1, the metal film 30 is not formed in a welded portion 32 of the electrode rods 16 and the metal foils (24, 24') to prevent foil floating of the metal foils (24, 24'). This will be described more specifically.

The inventors of the present invention produced a lamp in which the metal film 30 is formed up to the welding portion 32, and observed the lamp. In a lamp enclosing mercury in an amount of 300 mg/cc or more, so-called "foil floating" occurred. More specifically, a part (Pt, Au) of the plated metal film 30 is evaporated by heat generated during sealing in a lamp production process and goes into the gap between the glass portions of the sealing portions (20, 20') and the metal foils (24, 24'), and is attached to a portion of the metal foils. Then, a slight gap is formed between the glass portion and the metal foils that are attached tightly to each other, and thus foil floating occurs. This foil floating is not preferable because it may cause leakage or breakage. In the case of the structure of the lamp 100 in which the metal film 30 is not formed in the welded portion 32, the foil floating can be prevented effectively. In the case where the mercury amount of 300 mg/cc or more, leakage due to the foil floating occurs significantly, and therefore it is preferable that in such a case, the metal film 30 is not formed on the welded portion 32. When the mercury amount is less than 300 mg/cc, the phenomenon of foil floating is not significantly seen, so that it is possible to form the metal film 30 up to the welded portion 32.

Not only with the structure in which the metal film 30 is not formed in the welded portion 32 at all, but also with the structure in which the thickness of the metal film 30 on the welded portion 32 is smaller than that on the other portions, the effect of preventing the foil floating can be obtained. More specifically, the structure in which A<B, where the thickness of the metal film 30 on the welded portion 32 is A, and the thickness of the metal film 30 on the portions other than the welded portion 32 is B, can be used. For example, A can be B/2 or less, B/4 or less or the like. According to the experiments of the inventors of the present invention, with structure in which B is 1 μm, foil floating can be suppressed. Therefore, it is preferable that B is 1 μm, and it is more preferable that B is 0.1 μm or less to suppress foil floating effectively.

In this embodiment, the metal film 30 is of a two-layered structure of Pt/Au, so that the wettability between the metal film 30 (Pt layer) and the quartz glass becomes poor, which can make it difficult to attach the metal film 30 to the quartz glass. In addition, the attachment between the metal film 30 (Au layer) and the electrode rod (W rod) 16 can be improved. When the attachment between the metal film 30 and the electrode rod (W rod) 16 can be improved, the amount of the metal film 30 evaporated during heating can be suppressed effectively, so that foil floating can be suppressed more reliably. In addition, since the film strength is increased, film detachment due to contact of electrodes during storage or production or the like can be prevented. In this embodiment, the metal film 30 is of a two-layered structure, but can be of a one-layered structure or a three-layered structure. Furthermore, a structure in which the two-layered structure of Pt/Au is repeated (four layers, six layers, etc.) also can be used. In the structure of the lamp 100, the metal film 30 containing Pt is used, but instead of Pt, or in addition to Pt, the metal film 30 containing Ir, Rh, Ru, or Re can be used.

Furthermore, the metal film 30 is not necessarily formed on the entire surface of the portion of the electrode rod 16 that is buried in the sealing portions (20, 20'), but can be partially formed. For example, the experiments confirmed that even with if the metal film 30 is formed in an area of about ⅓ of the metal film 30 shown in FIG. 1, the effect of preventing blackening or preventing cracks can be provided. The metal film 30 may be formed on the surface of the electrode rod 16 that is exposed to the luminous bulb 10, although it does not contribute to the effect of preventing cracks. In this case, it is preferable to design the structure not to introduce Pt or the like in the luminous bulb 10 in an amount more than necessary, that is, not to make the luminous bulb 10 opaque. According to the experiments of the inventors of the present invention, when the thickness of the metal film 30 was 0.01 μm or more, the effect by the metal film 30 was exhibited significantly. When it was less than 0.01 μm, the metal film 30 was scattered by evaporation during heating, and the effect of preventing cracks was reduced. On the other hand, when the thickness was more than 10 μm, the amount of the metal scattered to the luminous bulb 10 was too much, resulting in opaqueness of the luminous bulb 10. Therefore, it is preferable that the thickness of the metal film 30 is about 0.01 μm to 10 μm.

Figure 3:
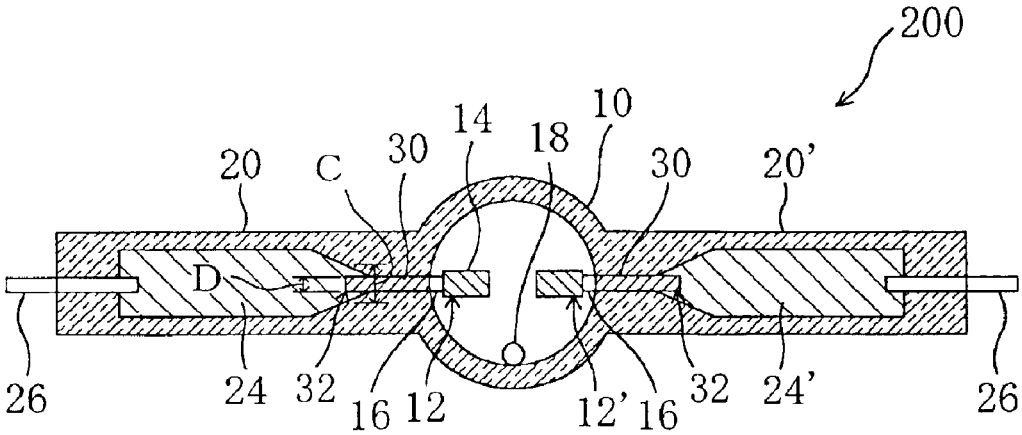
FIG. 3 is a schematic cross-sectional view showing the structure of a lamp 200 of Embodiment 1 of the present invention.

In order to avoid the problem of foil floating with more emphasis, the structure shown in FIG. 3 can be used. In a lamp 200 shown in FIG. 3, the width of the metal foil 24 in the welded portion 32 is narrowed, so that the metal evaporated and scattered from the metal film 30 by heating is not attached to the metal foils (24, 24') as little as possible. More specifically, this is configured so as to satisfy C<2D, where C is the width of the metal foil 24 in the welded portion 32, and D is the outer diameter of the electrode in the welded portion. Since the influence of the evaporation and the scattering of the metal film 30 positioned near the end of the electrode rod 16 is comparatively large, the width C and the outer diameter D were determined based on the position of the end of the electrode rod 16 in the welded portion 32 in this embodiment. Also in the structure shown in FIG. 3, it is preferable that the thickness of the metal film 30 in the welded portion 32 satisfies A<B (A is the thickness thereof in the welded portion, and B is the thickness thereof in portions other than the welded portion 32, and it is more preferable that the metal film 30 is not formed in the welded portion 32.

Figure 4:
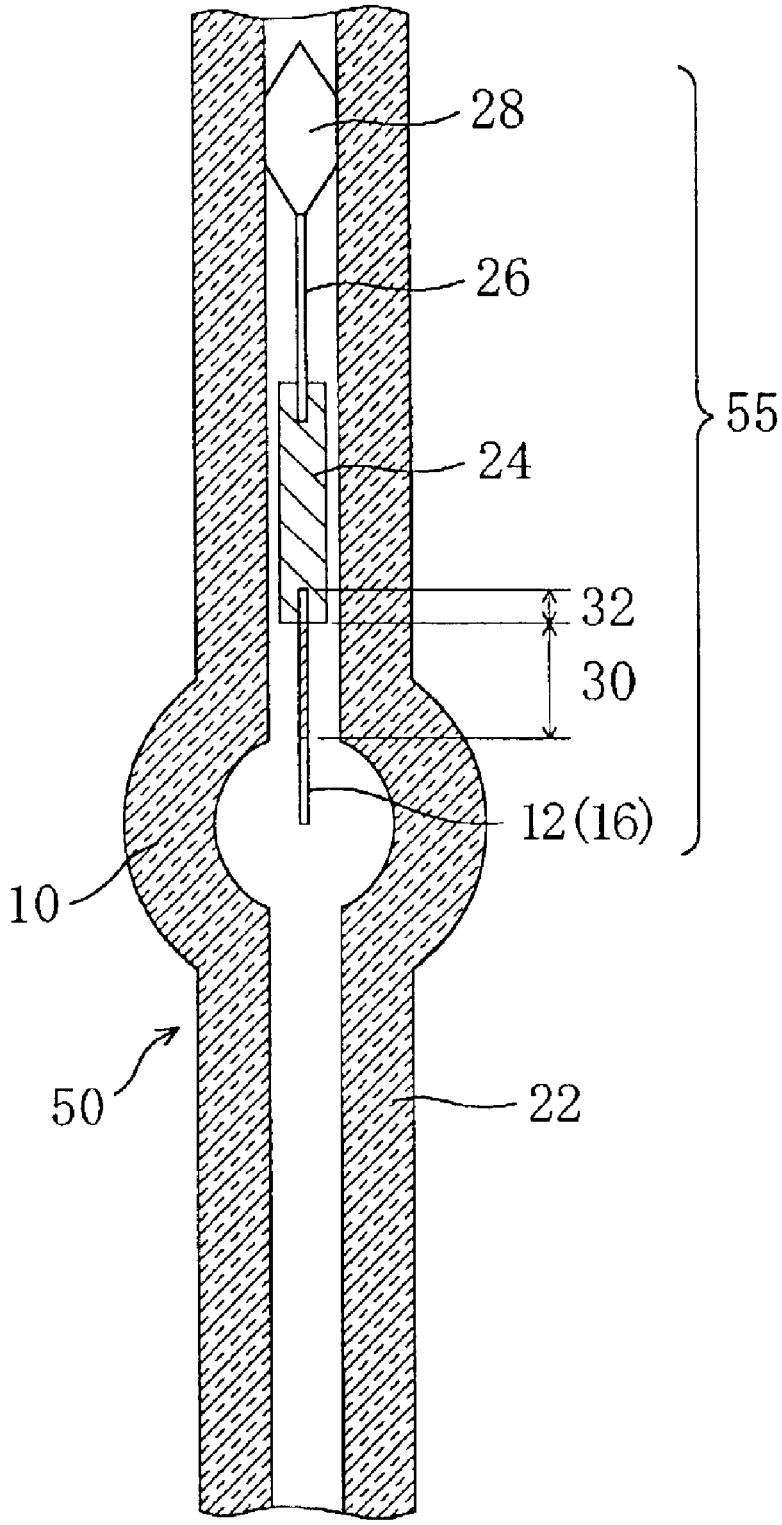
FIG. 4 is a cross-sectional view for illustrating an electrode insertion process.

Next, referring to FIG. 4, a method for producing the lamp 100 of this embodiment will be described. FIG. 4 is a cross-sectional view showing a process in which an electrode structure 55 containing an electrode 12 is inserted into a glass pipe 50 for a discharge lamp.

First, the glass pipe 50 for a discharge lamp having a portion (luminous bulb portion) that is to serve as the luminous bulb 10 and a pair of side tube portions 22 that are to serve as the glass portions of the sealing portions (20, 20') is prepared. The side tube portions 22 are extending from the luminous tube portion 10, and they (10, 22) are both made of quartz glass. In this embodiment, high purity quartz glass having a low level of alkali metal impurities (e.g., 1 ppm) may be used as the quartz glass. However, the present invention is not limited to such a quartz glass, but a glass pipe for a discharge lamp made of quartz glass having a not very low level of alkali impurities can be prepared and used. The outer diameter and the inner diameter of the luminous tube portion 10 of the prepared glass pipe 50 are 10 mm and 5 mm, respectively, and the outer diameter and the inner diameter of the side tube portion 22 are 6 mm and 2 mm, respectively.

Apart from the above-process, the electrode structure 55 in which one end of the electrode rod 16 provided with the metal film 30 is connected to the metal foil 24 is prepared. In the electrode structure 55, the electrode rod 16 (electrode 12) and a lead wire 26 are welded to the metal foil 24 (Mo foil), and a supporting member 28 for fixing the electrode structure 55 to the inner surface of the side tube portion 22 is provided in one end of the lead wire 26. The supporting member 28 shown in FIG. 4 is a molybdenum tape (Mo tape) made of molybdenum, but a ring-like spring made of molybdenum can be used as well.

The metal film 30 is formed in the portion of the electrode rod 16 that is positioned in the side tube portion 22. The metal film 30 is not formed in the portion 32 that is welded to the Mo foil 24 to prevent foil floating. Here, an electrode structure 55 that satisfies the condition of $A<B$ (A is the thickness of the welded portion 32 and B is the thickness of the portions other than the welded portion 32) can be used. To produce the lamp 200, an electrode structure 55 that satisfies the condition of $C<2D$ (C is the width of the metal foil 24 in the welded portion 32, and D is the outer diameter of the electrode rod 16 in the welded portion 32) can be used. In this example, the metal film 30 is not formed in the portion that is exposed to the luminous bulb 10. The electrode rod 16 is, for example, a tungsten rod having a diameter $\phi$ of 0.3 mm. The width of the metal foil 24 is 1.5 mm. The lead wire 26 is, for example, a lead wire made of molybdenum having a diameter $\phi$ of 0.5 mm.

Next, the electrode structure 55 is inserted into the side tube portion 22 of the glass pipe 50 (electrode insertion process). After this process, the state shown in FIG. 4 can be obtained. A coil wound around the head of the electrode rod 16 is omitted in FIG. 4.

Thereafter, the side tube portion 22 is heated and sealed so that the side tube portion 22 and the metal foil 24 are tightly attached (sealing portion formation process). More specifically, the pressure in the glass pipe 50 is reduced (e.g., less than 1 atm), and the side tube portion 22 is heated and softened with, for example, a burner, and then the side tube portion 22 and metal foil 24 are tightly attached. Thus, the sealing portion 20 can be obtained. In this process, the electrode rod 16 positioned in the side tube portion 22 is buried in the sealing portion 20. In this embodiment, the metal film 30 that degrades the wettability with quartz glass is formed on the surface of the electrode rod 16 in the sealing portions 20, so that in cooling after heating, cracks are suppressed from being generated in the glass positioned around the electrode rod 16. Furthermore, in the process of forming the sealing portions, the electrode rod 16 having the metal film 30 is also heated, so that a part of the metal film 30 is evaporated and is scattered.

Next, a material to be enclosed such as mercury 18 is introduced from the side tube portion 22 that has not been sealed yet, and then the electrode insertion process and the sealing portion formation process are performed to that side tube portion 22 so that the sealing portion 20' can be obtained. Finally, the sealing portions (20, 20') are cut at an appropriate length to expose the lead wires 26 so that the lamp 100 of this embodiment can be obtained. Pt evaporated and scattered from the metal film 30 during heating in the sealing portion formation process is present in the luminous bulb 10 of this lamp 100. Not only Pt is introduced into the luminous bulb 10 by heating in the sealing portion formation process, but also Pt can be introduced into the luminous bulb 10 by heating the metal film 30 by laser or the like.

Next, referring to FIGS. 5A to 5D, the production method of this embodiment will be described in greater detail.

Figure 5A:
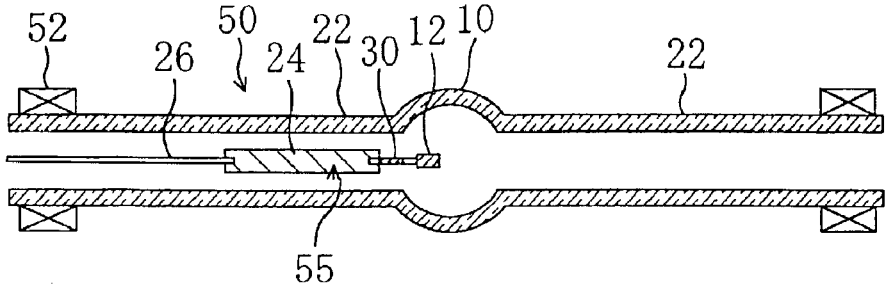
FIGS. 5A to 5D are cross-sectional views showing a process sequence of a production method according to Embodiment 1.

First, the glass pipe 50 having the luminous bulb 10 and the side tube portions 22 is prepared, and then as shown in FIG. 5A, the electrode structure 55 is inserted into one side tube portion 22. The metal film 30 is formed in a part of the electrode 12 of the electrode structure 55. The glass pipe 50 is supported by a chuck 52 in such a manner that it can be rotated. The Mo tape 28 is not shown in FIGS. 5A to 5D.

Next, the electrode structure 55 is fixed to a predetermined position, and then the glass pipe 50 is put in a state in which the pressure thereof can be reduced, and the luminous bulb 10 is evacuated to a vacuum. Then, Ar with about 200 torr is introduced therein.

Figure 5B:
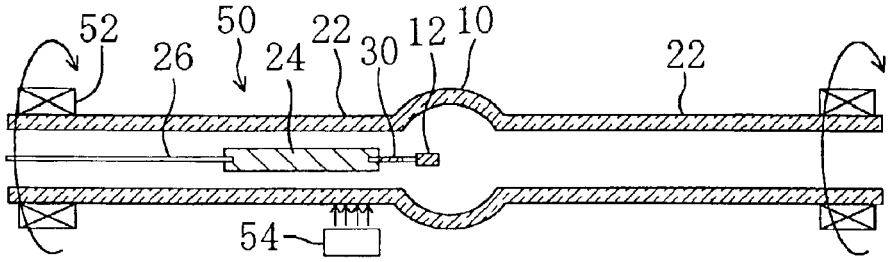

Next, as shown in FIG. 5B, the side tube portion 22 is heated with an oxygen-hydrogen burner while rotating the glass pipe 50 so that shrinking sealing is performed. After shrinking sealing is finished with respect to one side tube portion 22, mercury in an amount of 18 to 24 mg (the amount of mercury with respect to the inner volume of the luminous bulb is 300 to 400 mg/cc) is introduced into the luminous bulb 10.

Thereafter, the electrode structure 55 including the metal foil 24' is inserted into the side tube portion 22 that has not been sealed yet and fixed to a predetermined position. Then, the luminous bulb 10 is evacuated to a vacuum, and then Ar gas containing bromide is enclosed at 200 torr therein.

Figure 5C:
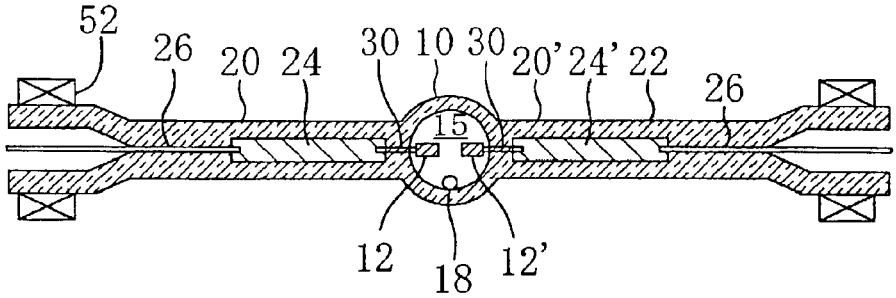

Next, the remaining side tube portion 22 is heated for shrinking sealing, as shown in FIG. 5B, while the mercury in the luminous bulb 10 is cooled with liquid nitrogen. Thus, as shown in FIG. 5C, a pair of sealing portions (20, 20') are formed so that a luminous bulb 10 having discharge space 15 can be obtained.

Figure 5D:
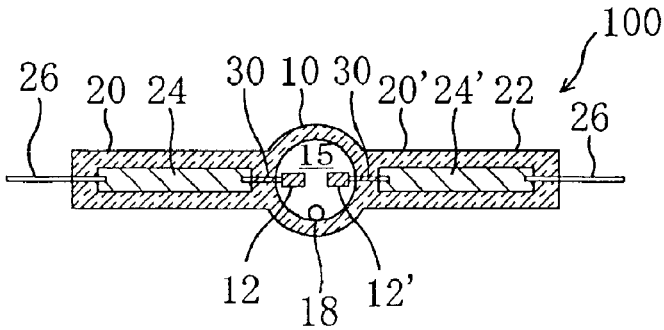

Finally, the unwanted portions of the side tube portions 22 are cut to exposed the lead wires 26, so that the lamp 100 can be completed, as shown in FIG. 5D.

In the lamp 100 of this embodiment, since at least one metal selected from the group consisting of Pt, Ir, Rh, Ru and Re is present in the luminous bulb 10, a high pressure discharge lamp having a long life in which blackening is effectively prevented from occurring can be realized.

Furthermore, since the metal film 30 containing at least one metal selected from the group consisting of Pt, Ir, Rh, Ru and Re is formed on the surface of at least a part of a portion of the electrodes (12, 12') that is positioned in the sealing portions (20, 20'), cracks are prevented from being generated in the glass positioned around the electrode base. As a result, a high pressure discharge lamp having a very high strength against pressure that has not been achieved so far can be obtained.

Moreover, the effect of preventing foil floating can be obtained by not forming the metal film 30 in the welded portion 32. The effect of preventing foil floating also can be obtained by satisfying A<B (A is the thickness of the welded portion 32 and B is the thickness of the portions other than the welded portion 32) or C<2D (C is the width of the metal foil 24 in the welded portion 32 and D is the outer diameter of the electrode rod 16 in the welded portion 32).

In the lamps 100 and 200 of this embodiment, the structures of a pair of electrodes (12, 12') and a pair of sealing portions (20, 20') are symmetrical, but the present invention is not limited thereto. If the metal film 30 is formed in at least one electrode, the above-described effects can be obtained, when comparing to the conventional lamps. Furthermore, it is possible that one sealing portion has the structure of that of the lamp 100 and the other sealing portion has the structure of that of the lamp 200. In addition, to achieve a structure for an alternating current operation, it is possible to change the shape of the electrode, depending on a cathode or an anode.

Embodiment 2

Figure 6:
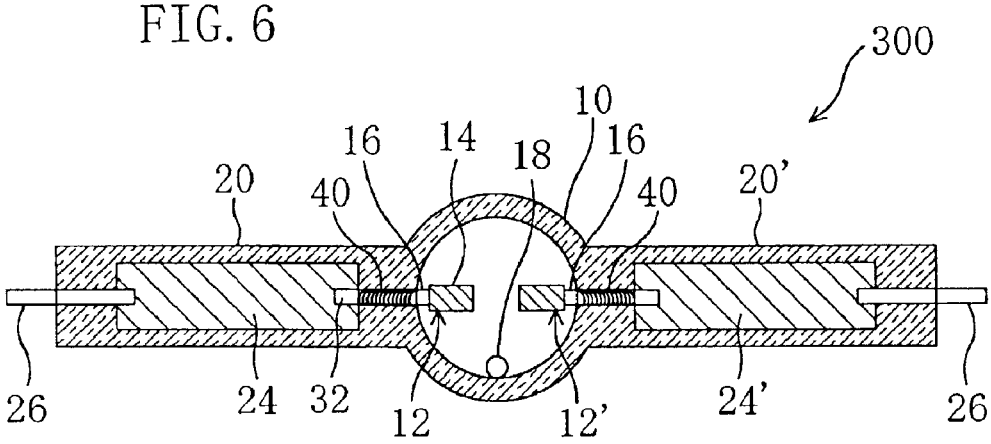
FIG. 6 is a schematic cross-sectional view showing the structure of a lamp 300 of Embodiment 2 of the present invention.

Referring to FIG. 6, a high pressure discharge lamp 300 of Embodiment 2 according to the present invention will be described. FIG. 6 is a schematic view showing the structure of the lamp 300.

The lamp 300 of this embodiment is different from the lamp 100 of Embodiment 1 in that a coil 40 whose surface is coated with Pt is wound around a portion of the electrode rod 16 that is positioned in the sealing portions (20, 20') in the lamp 300, as opposed to the lamp 100 where the surface of the electrode rod 16 that is positioned in the sealing portions (20, 20') is coated with Pt. Other aspects are basically the same as in the structure of the lamp 100. For simplification of the description of this embodiment and the following embodiments, different aspects from in Embodiment 1 are mainly described and the same aspects as in Embodiment 1 are omitted or simplified.

The coil 40 in the lamp 300, is for example, a tungsten coil whose surface is placed with Pt (upper layer)/Au (lower layer). In other words, the metal film 30 of Embodiment 1 is formed on the surface of the coil 40. This has a two-layered structure in which the Au layer is formed as the lower layer to improve the attachment properties. As described in Embodiment 1, a coil 40 plated only with Pt without the two-layered structure of Pt (upper layer)/Au (lower layer) can provide sufficient attachment properties in practical use. Furthermore, the metal film 30 can be formed not only by plating, but also sputtering, evaporation or a method for applying a metal solution and firing it for attachment. Instead of plating the surface of a coil, a coin containing Pt as a material (including Pt coil) can be used. In addition, instead of Pt or together with Pt, elements of the platinum group such as Ir, Rh, Ru and Re can be used.

Figure 7:
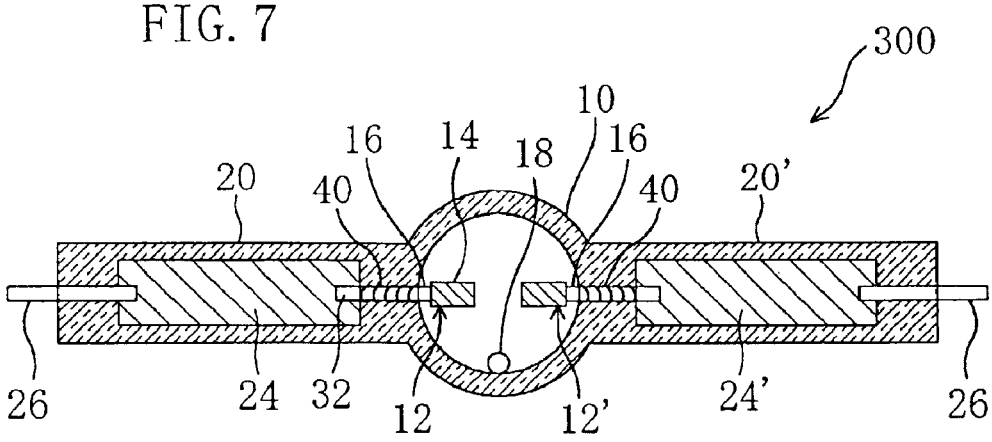
FIG. 7 is a schematic cross-sectional view showing the structure of a variation of the lamp 300 of Embodiment 2 of the present invention.

It is preferable that the diameter of the coil 40 is ½ or less of the diameter of the electrode rod 16 in view of detachment or breakage of the metal foil 24. In this embodiment, a tungsten coil having a diameter of 0.06 mm is wound around a tungsten rod 16 having a diameter $\phi$ of 0.3 mm. In the lamp 300 shown in FIG. 6, the coil has about 20 to 50 turns with no gap between the turns, but the present invention is not limited thereto and there may be a gap between the turns, as shown in FIG. 7.

As in the lamp 300 of this embodiment, also when the coil 40 whose surface is plated with Pt is wound around a portion (base portion of the electrode) of the electrode rod 16 that is buried in the sealing portions (20, 20'), the same effect as in Embodiment 1 can be obtained. More specifically, Pt is evaporated and scattered from the Pt plating (metal film 30) on the surface of the coil 40 so that Pt can be introduced into the luminous bulb 10. In addition, cracks is prevented from being generated in the glass around the electrode rod 16 by utilizing poor wettability between the Pt and the quartz glass.

The lamp 300 of this embodiment has larger advantages for production process than the lamp 100 of Embodiment 1. In the case of lamp 300, it is possible to prepare previously plated coils 40 in a mass amount. Then, it is sufficient to wind the coil 40 the base of the electrode rod 16 of the commonly used electrode structure (the electrode structure 55 shown in FIG. 4 but the metal film 30 is not formed therein).

In order to produce the lamp 300, the processes shown in FIG. 5A to 5B can be performed with the electrode structure 55 wound with the coil 40. Herein, "winding an electrode rod with a coil" refers to inserting an electrode rod through a coil that has been completed by winding a metal wire for a coil so as to provide such that the inner surface of the cylindrical coil is in contact with or close to the electrode rod, and also producing directly a coil by winding a metal wire for a coil around an electrode rod so as to provide the coil in the outer circumference of the electrode rod. In the case of mass production, it is preferable to prepare a completed coil, and insert the electrode rod through the coil so as to provide the coil in the outer circumference of the electrode rod.

Figure 8A:
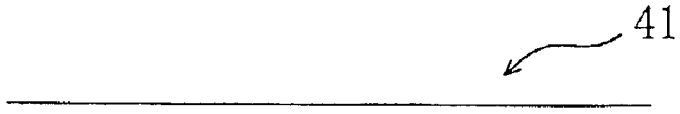
FIGS. 8A to 8D are cross-sectional views for illustrating a process sequence of a method for producing a coil 40.
Figure 8B:
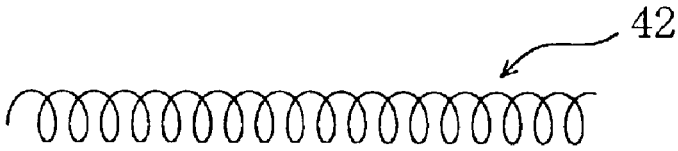
Figure 8C:
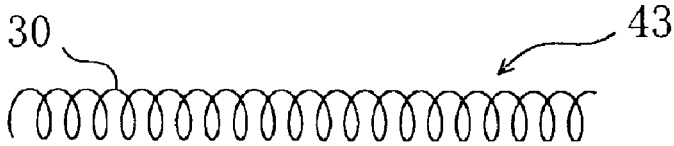
Figure 8D:
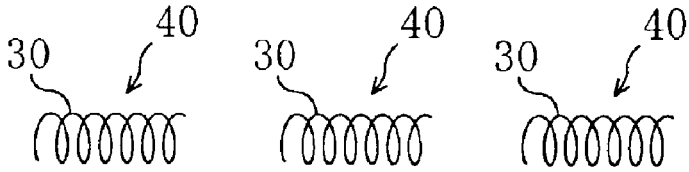
Figure 9A:
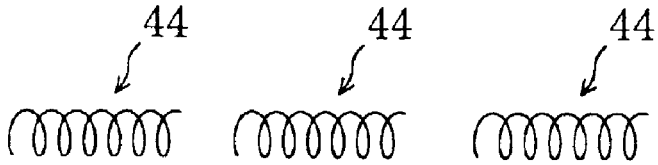
Figure 9B:
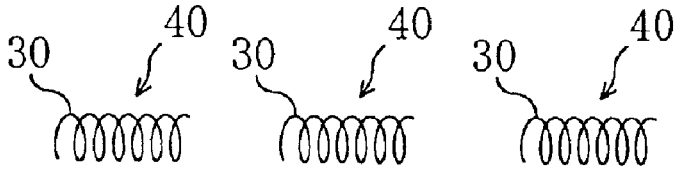

In the case where the coil 40 is prepared (in particular, a large number of previously plated coils 40 are prepared), the following procedure is performed. After a metal wire 41 is prepared as shown in FIG. 8A, a coil 42 in the first stage is produced from the metal wire 41, and then as shown in FIG. 8C, the coil 42 is plated so that a coil 43 provided with the metal film 30 containing Pt at least on its surface can be obtained. The metal film 30 also can be formed by evaporation or the like, instead of plating. Finally, when the coil 43 is cut to a predetermined length, the coil 40 provided with the metal film 30 can be obtained. After the processes shown in FIGS. 8A and 8B, the coil 42 in the first stage is cut to a predetermined length to form the coil 44, as shown in FIG. 9A, and then as shown in FIG. 9B, the coil 44 is plated so that the coil 44 having the metal film 30 can be produced.

Figure 10A:
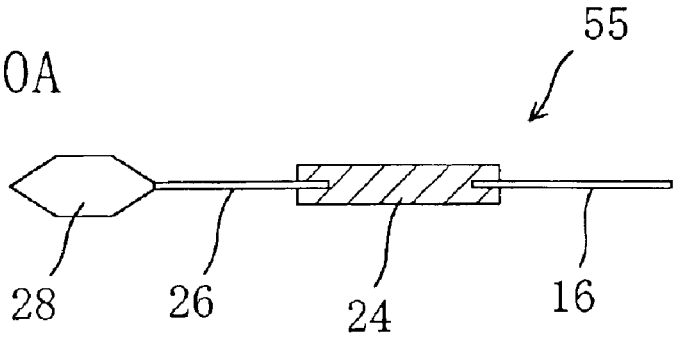
FIGS. 10A to 10C are cross-sectional views for illustrating a process sequence for inserting and fixing the coil 40 to the electrode rod 16.
Figure 10B:
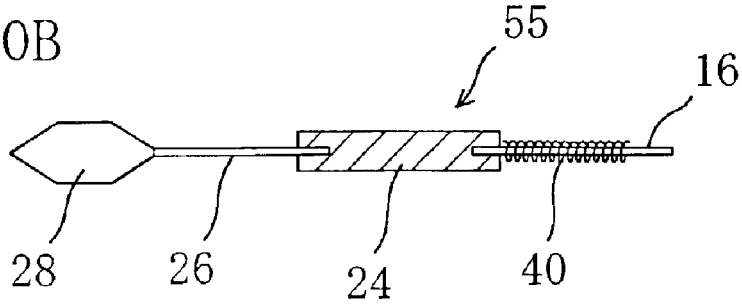

The electrode rod 16 is inserted through the thus produced coil 40 and thereafter is subjected to a process of producing a lamp. For example, as shown in FIG. 10A, after the electrode structure 55 having the electrode rod 16, the metal foil 24 and the like is prepared, as shown in FIG. 10B, the electrode rod 16 of the electrode structure 55 is inserted through the coil 40. Thereafter, if necessary, as shown in FIG. 10C, a predetermined portion of the coil 40 (e.g., a portion in the center) is welded so that the coil 40 is fixed to the electrode rod 16 with the welded portion 34.

Figure 10C:
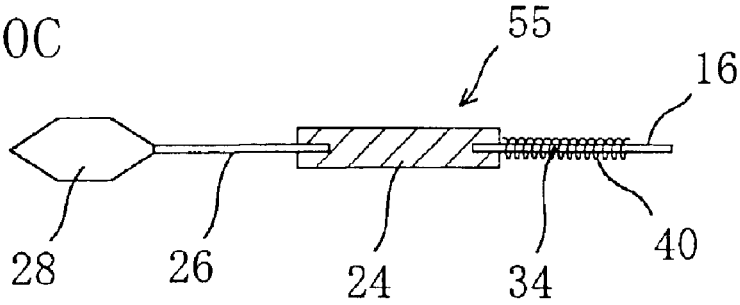

When the coil 40 is fixed to the electrode rod 16 in the manner as shown in FIG. 10C, the coil 40 can be floated (detached) from the electrode rod 16 in the portions other than the welded portion 34. Therefore, a gap is created between the coil 40 and the electrode rod 16, so that it is possible to reduce a pressure load that is applied to the electrode rod 16 by the coil 40. In particular, when producing a discharge lamp having a high power and a long life, electrode rods made of very high purity tungsten are often used as the electrode rod 16. The high purity tungsten rod does not have so high strength as tungsten whose purity is not so high. Therefore, when a high purity tungsten rod is used, the significance of using the method for reducing the pressure load by the gap becomes larger.

Examples of preferable high purity electrode rods are those having a content of each of sodium (Na), potassium (K) and lithium (Li) of 1 ppm or less. A lamp using such high purity electrode rods can provide the advantages that blackening that might occur because of the presence of alkali metal can be suppressed effectively, and light color is suppressed from being yellowish. This high purity electrode rods are disclosed in International Publication WO 01/29862 (corresponding to U.S. application Ser. No. 10/111,067), which is incorporated herein by reference.

The conditions of typical size or the like of the coil 40 is as follows. The diameter of the coil is about 0.06 mm (about 60 $\mu$m), and the pitch center distance (distance between the center of a wire and the center of the adjacent wire) is about 0.1 mm (about 100 $\mu$m). The distance between the adjacent wires is 0.04 mm (about 40 $\mu$m). The coil is wound with a gap between turns, because it is more difficult to wind the coil without a gap neatly than with a gap.

When the metal film 30 in Embodiments 1 and 2 is constituted only by Pt, the following advantages also can be obtained. When the metal film 30 is made only of Pt, although the attachment is slightly lower than in the case of the two-layered structure of the Pt (upper layer) and the Au (lower layer), a sufficient attachment that cannot cause any problem in practical use can be obtained. Moreover, only Pt can be present in the luminous bulb 10 and Au is not used, so that Au cannot be contaminated in the luminous bulb 10. As described above, Au is not an element that facilitates blackening, but when Au is present in luminous bulb 10, the viscosity of the mercury 18 in the luminous bulb 10 is increased, and in some cases, the mercury 18 is coupled between the electrodes 12, 12' (so-called mercury bridge) is likely to occur, which was found by the experiments of the inventors of the present invention. In the case where the metal film 30 is made only of Pt, it is possible to reduce the occurrence of such mercury bridge. The mercury bridge can be prevented by displacing one electrode rod with the other electrode rod. More specifically, in a high pressure mercury lamp (short arc type mercury lamp) in which the distance D between one electrode and the other electrode of a pair of electrodes is 2 mm or less, and the total mass of mercury enclosed is 150 mg/cm$^3$ or more, the shortest distance d (cm) between the head of one electrode and the head of other electrode should be larger than a value of $(6M/13.6\pi)^{1/3}$, where M (g) is the total mass of mercury enclosed. The countermeasure of the occurrence of mercury bridge is disclosed in Japanese Patent Application No. 2001-149500 (corresponding to U.S. application Ser. No. 09/865,964), which is incorporated herein by reference.

Embodiment 3

Figure 11:
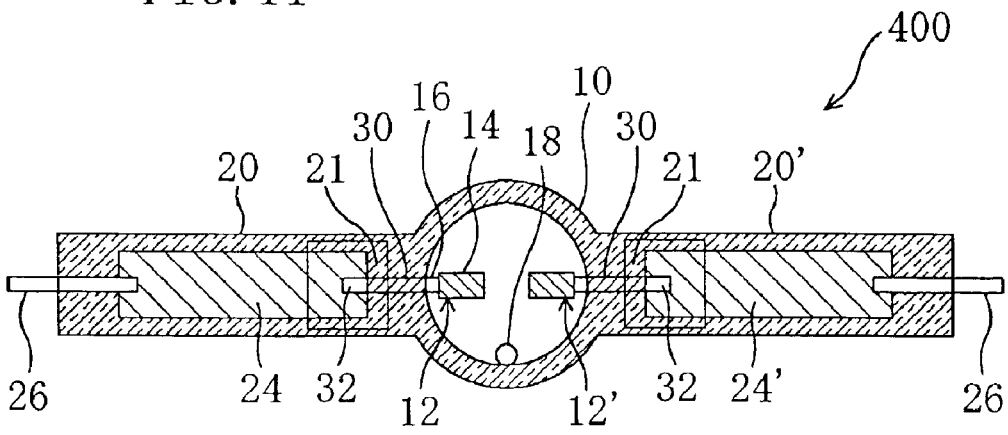
FIG. 11 is a schematic cross-sectional view showing the structure of a lamp 400 of Embodiment 3 of the present invention.

Referring to FIG. 11, a high pressure discharge lamp 400 of Embodiment 3 according to the present invention will be described. FIG. 11 is a schematic view showing the structure of the lamp 400.

The lamp 400 of this embodiment is different from the lamp 100 of Embodiment 1 in that a region 21 containing vycor glass is formed inside the sealing portions (20, 20') over the portion in which the electrode rods 16 and the metal foils (24, 24') are positioned. In other words, the lamp 400 of this embodiment has a structure in which the region 21 containing vycor glass is formed inside the sealing portions (20, 20') so as to cover a portion of the electrode rods 16 having the metal film 30 on its surface and a portion of the metal foils (24, 24'). In this structure, the periphery of the welded portion 32 is also covered with the region 21.

Vycor glass (product name) refers to glass having a reduced softening point by mixing an additive with quartz glass and having better processability than quartz glass. The composition thereof is, for example, 96.5 wt % of silica ($SiO_2$), 0.5 wt % of alumina ($Al_2O_3$) and 3 wt % of boron (B). In the sealing process for lamp production, the composition of the region 21 is a mixture of the vycor glass and quartz glass, and the vycor glass accounts for at least 50% (or the major part) of the region 21 of this embodiment. Describing the structure shown in FIG. 11 in greater detail, the vycor glass contained in the region 21 is distributed from the electrode rods 16 and the metal foils (24, 24') to the outer walls of the sealing portions (20, 20') (that is, from the center to the outer wall) and a the vycor glass is contained in a larger amount in the vicinity of the electrode rods and the metal foils (that is, on the side of the center).

As a result of the investigation of the inventors of the present invention regarding the strength against pressure of the lamp 400 of this embodiment in which the region 21 is provided in the structure of the lamp 100, it was found that the strength against pressure can be even higher than the lamp 100. The structure of the lamp 100 can increase the conventional strength against a pressure of about 20 MPa at most to 30 MPa or more, but the lamp 400 of this embodiment can increase the strength against pressure to even higher about 40 MPa or more. In the context that a lamp having strength against a pressure of about 30 MPa has not been realized yet, the strength against a pressure of about 40 MPa or more can be described as a surprising strength against pressure.

According to the experiments of the inventor of the present invention, when the amount of mercury enclosed is 200 mg/cm$^3$ (corresponding to an operation pressure of 20 MPa), the color rendering index Ra is 60, but when the amount of mercury enclosed is 400 mg/cm$^3$ (corresponding to an operation pressure of 40 MPa), the color rendering index Ra is increased to 70. When the arc intensity is taken as 1.00 at 200 mg/cm$^3$, it is increased to 1.2 at 400 mg/cm$^3$.

Figure 12:
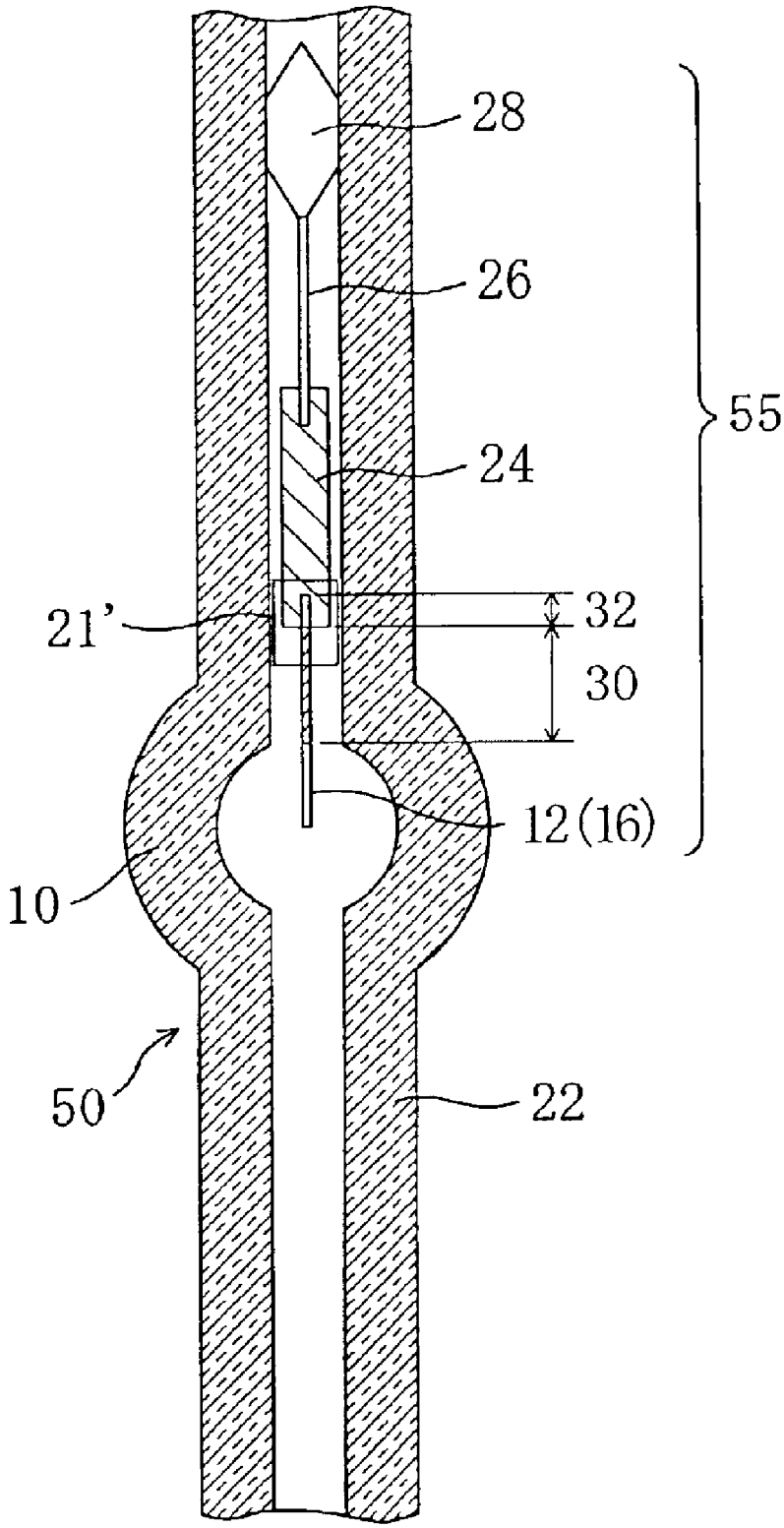
FIG. 12 is a schematic cross-sectional view for illustrating an electrode insertion process.

A method for producing the lamp 400 will be described with reference to FIG. 12. In FIG. 12, a glass sleeve 21' made of the vycor glass is provided so as to cover the base of the electrode rod 16, the welded portion 32, and a portion of the metal foil 24. The glass sleeve 21' made of the vycor glass that is prepared in this embodiment is cylindrical and has an outer diameter of 1.9 mm, an inner diameter of 1.7 mm, and a length of 5 mm. For easy fixation of the glass sleeve 21', a glass pipe in which the side tube portion 22 has a smaller inner in the vicinity of the boundary portion between the luminous bulb 10 and the side tube portion 22 of the glass pipe 50 can be used. Furthermore, a glass sleeve made of quartz glass can be prepared, and vycor glass powder can be attached to the inner surface thereof, and thus the region 21 can be formed of the vycor glass powder.

As shown in FIG. 12, after the electrode insertion process is performed, each process is performed as shown in FIGS. 5A to 5D, so that the lamp 400 can be obtained.

The structure provided with the region 21 can be applied, not only to the lamp 100, but also to the lamps 200 and 300. When it is applied to the lamp 300 shown in FIGS. 6 and 7, the region 21 can be provided over the portion in which the coil 40 wound around the electrode rod 16 and the metal foil (24, 24') are positioned.

The reason why the region 21 containing vycor glass improves the strength against pressure is not clear. It is estimated that vycor glass may increase the attachment in the sealing portions (20, 20'). The region 21 can be constituted such that particles of copper oxide or copper are dispersed. In order to disperse particles of copper oxide or copper in the region 21, particles o of copper oxide or copper are attached to the inner surface of the glass sleeve shown in FIG. 12, and thereafter the sealing portion formation process can be performed. It is advantageous for the effect of increasing the strength against pressure to let copper oxide or copper contained in the vycor glass. When copper oxide or copper is mixed with the region 21, it appears that black, red or brown particulate spots or vitrified spots are dispersed here and there in the glass.

Embodiment 4

Figure 13:
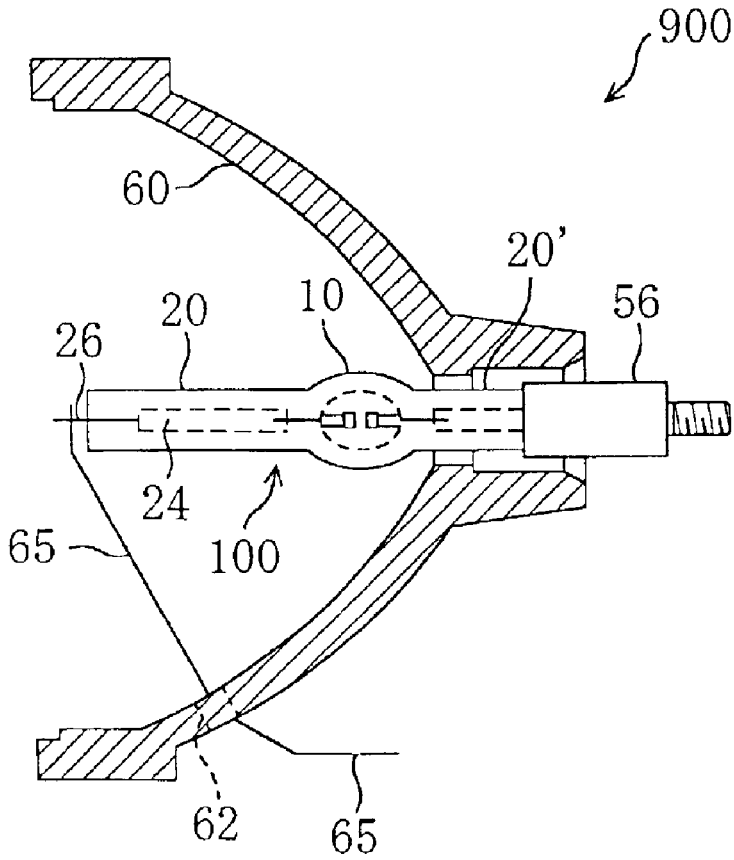
FIG. 13 is a schematic cross-sectional view showing the structure of a lamp 900 provided with a mirror.
Figure 14:
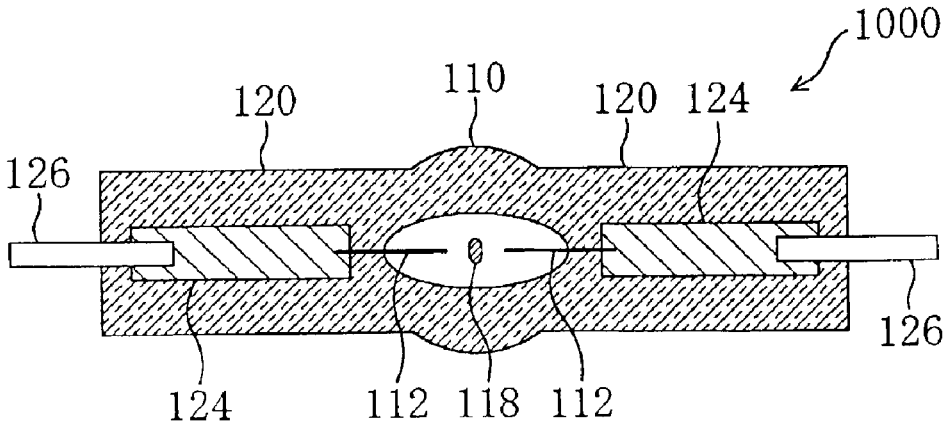
FIG. 14 is a schematic cross-sectional view showing the structure of a conventional high pressure discharge lamp.

The high pressure discharge lamps of Embodiments 1 to 3 can be formed into a lamp provided with a mirror or a lamp unit by combining a reflecting mirror. FIG. 13 is a schematic cross-sectional view of a lamp 900 provided with a mirror including the lamp 100 of Embodiment 1.

The lamp 900 provided with a mirror includes the lamp 100 including a substantially spherical luminous bulb 10 and a pair of sealing portions (20, 20') and a reflecting mirror 60 for reflecting light emitted from the lamp 100. The lamp 100 is only illustrative, and any one of the lamps 200 to 400 of the above embodiments can be used. The lamp 900 provided with a mirror may further include a lamp house holding the reflecting mirror 60. Herein, Lamp units encompass a lamp including a lamp house.

The reflecting mirror 60 is designed to reflect the radiated light from the discharge lamp 100 so that the light becomes, for example, a parallel luminous flux, a condensed luminous flux converged on a predetermined small area, or a divergent luminous flux equal to that emitted from a predetermined small area. As the reflecting mirror 60, a parabolic reflector or an ellipsoidal mirror can be used, for example.

In this embodiment, a lamp base 56 is attached to one sealing portion 20' of the discharge lamp 100, and the lead wire 26 extending from the sealing portion 20' and the lamp base 56 are electrically connected. The sealing portion 20' is adhered to the reflecting mirror 60, for example, with an inorganic adhesive (e.g., cement) so that they are integrated. A lead wire 26 of the sealing portion 20 positioned on the front opening side of the reflecting mirror 60 is electrically connected to the lead wire 65 for interconnection. The lead wire 65 for interconnection extends from the lead wire 26 to the outside of the reflecting mirror 60 through an opening for a lead wire 62 of the reflecting mirror 60. For example, a front glass can be attached to the front opening of the reflecting mirror 60.

Such a lamp provided with a mirror or a lamp unit can be attached to an image projection apparatus such as a projector employing liquid crystal or DMD, and is used as the light source for the image projection apparatus. The high pressure discharge lamp, the lamp provided with a mirror or the lamp unit of the above embodiments can be used, not only as the light source for image projection apparatuses, but also as a light source for ultraviolet steppers, or a light source for a sport stadium, a light source for headlights of automobiles, a light source for floodlight illuminating traffic signs or the like.

Other Embodiments

In the above embodiments, mercury lamps employing mercury as the luminous material have been described as an example of the high pressure discharge lamp of the present invention. However, the present invention can be applied to any discharge lamps in which the airtightness of the luminous bulb is maintained by the sealing portions (seal portions). For example, the present invention can be applied to a high pressure discharge lamp enclosing a metal halide such as a metal halide lamp. Also in metal halide lamps, it is preferable to prevent leakage and cracks. In recent years, mercury-free metal halide lamps that do not contain mercury are under rapid development, and the present invention can be applied to the metal halide lamps.

In the above embodiments, lamps having a mercury vapor pressure of about 20 MPa or more (the case of so-called ultra-high pressure mercury lamps) have been described. However, this does not mean that the application of the present invention to high-pressure mercury lamps in which the mercury vapor pressure is about 1 MPa is not eliminated. In other words, the present invention can be applied to all kinds of high pressure discharge lamps including ultra-high pressure mercury lamps and high pressure mercury lamps. Describing further, the fact that a lamp is operated stably even at a very high operating pressure means that the lamp has high reliability. This means that when the structure of this embodiment is applied to a lamp having a not very high operating pressure (a lamp having an operating pressure of less than 30 MPa. e.g., about 20 MPa to about 1 MPa), the reliability of the lamp operated at that operating pressure can be improved. Therefore, the structure of this embodiment can improve the lamp characteristics from the viewpoint of reliability. In the lamps of the above embodiments, the sealing portions (20, 20') are produced by shrinking, but this does not eliminate those produced by pinching.

Furthermore, the distance (arc length) between the pair of electrodes 12 and 12' can be the distance of a short arc type lamp, or can be longer than that. The lamps of the above embodiments can be used by either operating method of alternating current operation and direct current operation. The structure of the above embodiments can be used mutually, which means that a structure in combination of any of Embodiments 1 to 3 can be used.

The preferable examples of the present invention have been described, but these descriptions are not limiting the present invention, but various modifications can be made.

In a mercury lamp having a comparatively high mercury vapor pressure, known technologies that are directed to improving the structure of the sealing portions are as follows.

Figure 15A:
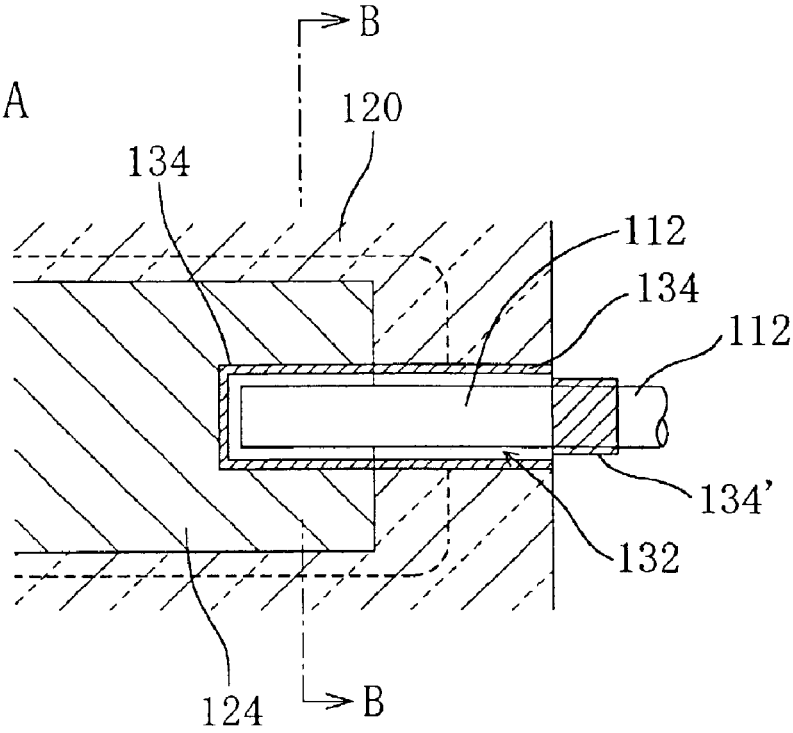
FIGS. 15A and 15B are cross-sectional views showing the structure of a known sealing portion.
Figure 15B:
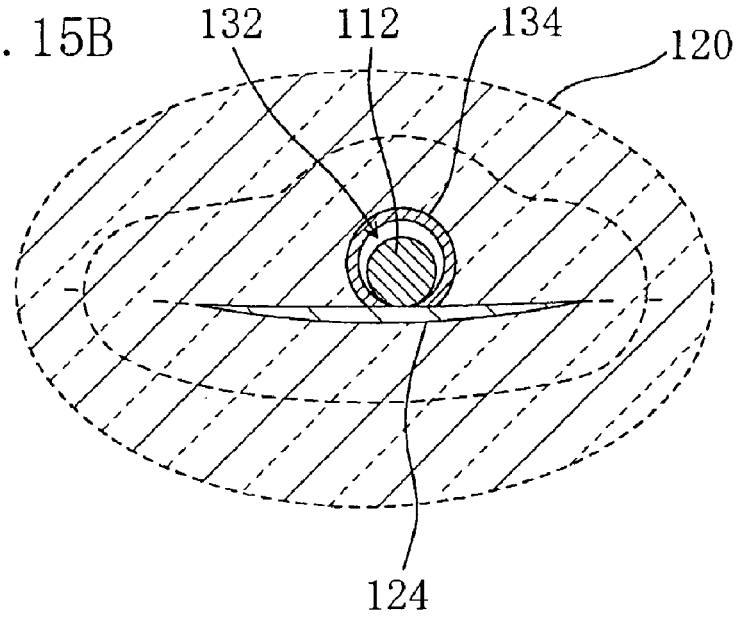

Japanese Laid-Open Patent Publication No. 2001-23570 discloses a structure of the sealing portions for improving the withstand pressure performance of an ultra-high pressure mercury lamp with about 190 atm (19 MPa). FIGS. 15A and 15B are enlarged views of the main portions of the structure of the sealing portions. FIG. 15A is a plan view of the portion (electrode base portion) in which the electrode 112 is buried in the sealing portion 120. FIG. 15B is a cross-sectional view taken along line B—B. As shown in FIGS. 15A and 15B, there is a gap 132 between the glass portion of the sealing portion 120 and the electrode 112, and a peeling layer 134 is formed on the surface of the glass portion on the side of the gap 132. The peeling layer 134 is peeled from the surface of the electrode 112 during cooling after sealing in the lamp production process so as to create the gap 132 between the glass portion of the sealing portion 120 and the electrode 112. This publication describes the gap 132 can prevent the generation of small cracks in the inner surface of the sealing portion 120.

As understood easily from FIGS. 15A and 15B, in this structure of the sealing portions, the peeling layer 134 is attached to the surface of the glass portion, and the metal film is not formed on the surface of the electrode 112 buried in the sealing portion 120. Furthermore, since the peeling layer 134 has to be attached to the surface of the glass portion in this structure, using the metal film having poor wettability with the glass portion contradicts the technology of this publication.

Figure 16:
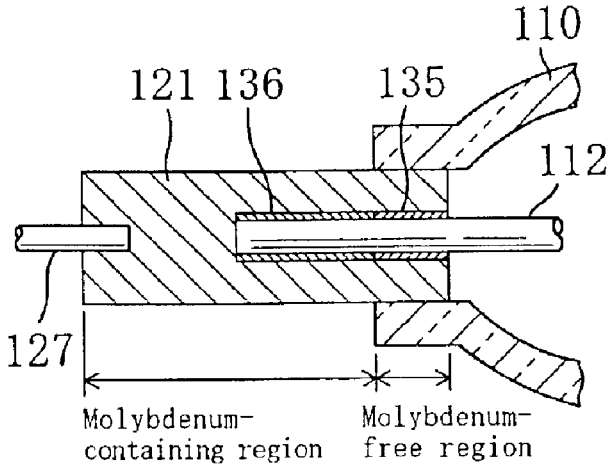
FIG. 16 is a cross-sectional view showing the configuration of a known closing structure.

Japanese Laid-Open Patent Publication No. 11-260315 discloses a closing structure without foils in an ultra-high pressure mercury lamp of 150 W. FIG. 16 is a cross-sectional view of this closing structure. The closing structure 121 closes a luminous bulb 110 and has a conductive component-containing region (molybdenum-containing region) and a conductive component-free region (molybdenum-free region). An electrode rod 112 is provided in the central hole of the closing structure 121 without any gap by firing for securing. The surface of the electrode rod 112 positioned in the central hole in the conductive component-free region is coated with a high melting point metal thin film 135, and the surface of the electrode rod 112 positioned in the central hole in the conductive component-containing region is coated with a high melting point metal powder 136. In the conductive component-containing region, a cathode terminal 127 is buried and fixed. This publication describes that when the electrode rod 112 is fired and secured in the central hole of the closing structure 121, the high melting point metal thin film 135 and the high melting point metal powder 136 prevent cracks from being generated, even if intense firing for securing is performed.

As understood from FIG. 16, this closing structure 121 has no foils and is produced by a firing for securing process. Therefore, its basic structure is different from that of the present invention.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A high pressure discharge lamp comprising:

a luminous bulb in which a pair of electrodes are opposed to each other in the bulb, and a sealing portion extending from the luminous bulb and having a portion of the electrode therein, wherein a metal film made of at least one metal selected from the group consisting of Pt, Ir, Rh, Ru and Re is formed on a surface of at least a part of the portion of the electrode that is positioned in the sealing portion; and wherein the metal film has a multilayered structure including an Au layer as a lower layer and a Pt layer as an upper layer.

2. The high pressure discharge lamp according to claim 1, wherein the electrode is connected to a metal foil provided in the sealing portion by welding, and the metal film is not formed on a welded portion with the metal foil, and formed on a surface of the electrode that is buried in the sealing portion.

3. The high pressure discharge lamp according to claim 1, wherein a part of the metal constituting the metal film is present in the luminous bulb.

4. The high pressure discharge lamp according to claim 1, wherein the metal film is made of Pt.

5. A high pressure discharge lamp comprising:

a luminous bulb in which a pair of electrodes are opposed to each other in the bulb;

a metal foil connected to the electrode by welding; and a sealing portion extending from the luminous bulb and sealing the metal foil, wherein the metal foil and a portion of the electrode are buried in the sealing portion, a metal film made of at least one metal selected from the group consisting of Pt, Ir, Rh, Ru and Re is formed on a surface of the portion of the electrode that is buried in the sealing portion, and $A<B$ is satisfied, where A is a thickness of the metal film in a welded portion of the metal foil and the electrode, and B is a thickness of the metal film in portions other than the welded portion; and wherein the metal film has a multilayered structure including an Au layer as a lower layer and a Pt layer as an upper layer.

6. A high pressure discharge lamp comprising:

a luminous bulb in which a pair of electrodes are opposed to each other in the bulb;

a metal foil connected to the electrode by welding; and a sealing portion extending from the luminous bulb and sealing the metal foil, wherein the metal foil and a portion of the electrode is buried in the sealing portion, a metal film made of at least one metal selected from the group consisting of Pt, Ir, Rh, Ru and Re is formed on a surface of the portion of the electrode that is buried in the sealing portion, and $C<2D$ is satisfied, where C is a width of the metal foil in a welded portion of the metal foil and the electrode, and D is an outer diameter of the electrode in the welded portion; and wherein the metal film has a multilayered structure including an Au layer as a lower layer and a Pt layer as an upper layer.

7. The high pressure discharge lamp according to claim 5 or 6, wherein a part of the metal constituting the metal film is present in the luminous bulb.

8. The high pressure discharge lamp according to claim 5 or 6, wherein the metal film is made of Pt.

9. A high pressure discharge lamp comprising:

a luminous bulb in which a pair of electrodes are opposed to each other in the bulb; and a sealing portion extending from the luminous bulb and having a portion of the electrode inside, wherein a coil having a metal film of at least one metal selected from the group consisting of Pt, Ir, Rh, Ru and Re on its surface is wound around the portion of the electrode that is positioned in the sealing portion.

10. A high pressure discharge lamp comprising:

a luminous bulb in which a pair of electrodes are opposed to each other in the bulb;

a metal foil connected to the electrode by welding; and a sealing portion extending from the luminous bulb and sealing the metal foil, wherein the metal foil and a portion of the electrode are buried in the sealing portion, and a coil having a metal film of at least one metal selected from the group consisting of Pt, Ir, Rh, Ru and Re on its surface is wound around the portion of the electrode that is buried in the sealing portion.

11. The high pressure discharge lamp according to claim 9 or 10, wherein a part of the metal constituting the metal film is present in the luminous bulb.

12. The high pressure discharge lamp according to claim 9 or 10, wherein the coil has a metal film made of Pt on its surface.

13. The high pressure discharge lamp according to claim 9 or 10, wherein the coil has a metal film having a multi-layered structure including an Au layer as a lower layer and a Pt layer as an upper layer on its surface.

14. The high pressure discharge lamp according to claim 1, 5, 6, 9 or 10, wherein at least mercury and halogen are contained in the luminous bulb, and at least one metal selected from the group consisting of Pt, Ir, Rh, Ru and Re is present in the luminous bulb.

15. The high pressure discharge lamp according to claim 14, wherein an amount of mercury enclosed per unit volume of the luminous bulb is 230 mg/cc or more.

16. The high pressure discharge lamp according to claim 15, wherein an amount of mercury enclosed per unit volume of the luminous bulb is 300 mg/cc or more.

17. The high pressure discharge lamp according to claim 14 wherein an operating pressure in the luminous bulb is 23 MPa or more.

18. The high pressure discharge lamp according to claim 17, wherein an operating pressure in the luminous bulb is 30 MPa or more.

19. The high pressure discharge lamp according to claim 14, wherein the metal present in the luminous bulb is Pt.

20. A high pressure discharge lamp comprising:

a luminous bulb in which a pair of electrodes are opposed to each other in the bulb;

a metal foil connected to the electrode by welding; and a sealing portion extending from the luminous bulb and sealing the metal foil, wherein the metal foil and a portion of the electrode are buried in the sealing portion, a metal film made of at least one metal selected from the group consisting of Pt, Ir, Rh and Ru is formed on a surface of the portion of the electrode that is buried in the sealing portion, and $A<B$ is satisfied, where A is a thickness of the metal film in a welded portion of the metal foil and the electrode, and B is a thickness of the metal film in portions other than the welded portion;

wherein the metal film is formed in a welded portion of the metal foil and the electrode.

* * * * *

UNITED STATES PATENT AND TRADEMARK OFFICE

CERTIFICATE OF CORRECTION

PATENT NO. : 6,867,544 B2
APPLICATION NO. : 10/234947
DATED : March 15, 2005
INVENTOR(S) : Kiyoshi Takahashi et al.

It is certified that error appears in the above-identified patent and that said Letters Patent is hereby corrected as shown below:

Title Page;

Item (56), References Cited; FOREIGN PATENT DOCUMENTS, insert the following:

--JP 2002-260581 A 9/2002--

Signed and Sealed this

First Day of August, 2006

JON W. DUDAS
*Director of the United States Patent and Trademark Office*